US008990094B2

(12) United States Patent
Krishnan et al.

(10) Patent No.: US 8,990,094 B2
(45) Date of Patent: Mar. 24, 2015

(54) CODING AND DECODING A TRANSIENT FRAME

(75) Inventors: Venkatesh Krishnan, San Diego, CA (US); Ananthapadmanabhan Arasanipalai Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 197 days.

(21) Appl. No.: 13/228,210

(22) Filed: Sep. 8, 2011

(65) Prior Publication Data

US 2012/0065980 A1 Mar. 15, 2012

Related U.S. Application Data

(60) Provisional application No. 61/382,460, filed on Sep. 13, 2010.

(51) Int. Cl.
*G10L 25/90* (2013.01)
*G10L 19/10* (2013.01)
(Continued)

(52) U.S. Cl.
CPC ..... *G10L 19/20* (2013.01); *G10L 19/025* (2013.01); *G10L 19/22* (2013.01); *G10L 25/93* (2013.01); *G10L 19/097* (2013.01)
USPC ..... 704/500; 704/219; 704/205; 704/206; 704/207; 704/208; 704/223; 704/225; 704/216; 704/214; 704/265; 704/230; 704/229; 704/217

(58) Field of Classification Search
CPC ..... H05K 999/99; H04B 1/665; G10L 25/90; G10L 25/93; G10L 19/10; G10L 19/12; G10L 19/0212; G10L 19/008; G10L 21/0208; G10L 13/04
USPC ..... 704/262, 258, 270, 265, 219, 205–208, 704/500, 223, 225, 216, 214, 230, 229, 217
See application file for complete search history.

(56) References Cited

U.S. PATENT DOCUMENTS 4,991,213 A * 2/1991 Wilson ..... 704/207
5,754,974 A * 5/1998 Griffin et al. ..... 704/206
(Continued)

FOREIGN PATENT DOCUMENTS

GB 002398983 A * 9/2004
JP H1097294 A 4/1998
(Continued)

OTHER PUBLICATIONS

Ding et al., "How to Track Pitch Pulses in LP Residual?", IEEE, 2001.*
(Continued)

*Primary Examiner* — Pierre-Louis Desir
*Assistant Examiner* — Anne Thomas-Homescu
(74) *Attorney, Agent, or Firm* — Austin Rapp & Hardman

(57) ABSTRACT

An electronic device for coding a transient frame is described. The electronic device includes a processor and executable instructions stored in memory that is in electronic communication with the processor. The electronic device obtains a current transient frame. The electronic device also obtains a residual signal based on the current transient frame. Additionally, the electronic device determines a set of peak locations based on the residual signal. The electronic device further determines whether to use a first coding mode or a second coding mode for coding the current transient frame based on at least the set of peak locations. The electronic device also synthesizes an excitation based on the first coding mode if the first coding mode is determined. The electronic device also synthesizes an excitation based on the second coding mode if the second coding mode is determined.

51 Claims, 16 Drawing Sheets

(51) Int. Cl.

| | |
|---|---|
| ***G10L 19/12*** | (2013.01) |
| ***G10L 21/0208*** | (2013.01) |
| ***G10L 13/04*** | (2013.01) |
| ***G10L 19/008*** | (2013.01) |
| ***G10L 19/20*** | (2013.01) |
| ***G10L 19/025*** | (2013.01) |
| ***G10L 19/22*** | (2013.01) |
| *G10L 25/93* | (2013.01) |
| *G10L 19/097* | (2013.01) |

(56) References Cited

U.S. PATENT DOCUMENTS

| | | | | |
|---|---|---|---|---|
| 5,781,880 | A * | 7/1998 | Su | 704/207 |
| 5,809,455 | A * | 9/1998 | Nishiguchi et al. | 704/214 |
| 5,864,795 | A * | 1/1999 | Bartkowiak | 704/216 |
| 5,946,651 | A * | 8/1999 | Jarvinen et al. | 704/223 |
| 6,014,622 | A * | 1/2000 | Su et al. | 704/223 |
| 6,029,133 | A * | 2/2000 | Wei | 704/265 |
| 6,260,017 | B1 * | 7/2001 | Das et al. | 704/265 |
| 6,311,154 | B1 * | 10/2001 | Gersho et al. | 704/219 |
| 6,324,505 | B1 * | 11/2001 | Choy et al. | 704/230 |
| 6,438,518 | B1 | 8/2002 | Manjunath et al. | |
| 6,470,313 | B1 * | 10/2002 | Ojala | 704/223 |
| 6,475,245 | B2 * | 11/2002 | Gersho et al. | 704/208 |
| 6,640,209 | B1 | 10/2003 | Das | |
| 7,386,445 | B2 * | 6/2008 | Ojala | 704/219 |
| 7,885,819 | B2 * | 2/2011 | Koishida et al. | 704/500 |
| 8,165,873 | B2 * | 4/2012 | Yamada | 704/207 |
| 2001/0003812 | A1 * | 6/2001 | Ehara et al. | 704/207 |
| 2004/0138874 | A1 * | 7/2004 | Kaajas et al. | 704/205 |
| 2005/0091044 | A1 * | 4/2005 | Ramo et al. | 704/207 |
| 2007/0033014 | A1 * | 2/2007 | Gerrits et al. | 704/219 |
| 2007/0185708 | A1 * | 8/2007 | Manjunath et al. | 704/207 |
| 2009/0119096 | A1 * | 5/2009 | Gerl et al. | 704/207 |
| 2009/0177466 | A1 * | 7/2009 | Rui et al. | 704/225 |
| 2009/0198501 | A1 * | 8/2009 | Jeong et al. | 704/500 |
| 2009/0319261 | A1 * | 12/2009 | Gupta et al. | 704/207 |
| 2009/0319262 | A1 * | 12/2009 | Gupta et al. | 704/207 |
| 2009/0319263 | A1 * | 12/2009 | Gupta et al. | 704/229 |
| 2010/0125452 | A1 * | 5/2010 | Sun | 704/208 |
| 2011/0082693 | A1 * | 4/2011 | Krishnan et al. | 704/225 |
| 2012/0221336 | A1 * | 8/2012 | Degani et al. | 704/250 |
| 2012/0296641 | A1 * | 11/2012 | Rajendran et al. | 704/206 |

FOREIGN PATENT DOCUMENTS

| | | | |
|---|---|---|---|
| JP | 2004109803 | A | 4/2004 |
| KR | 19980024970 | | 7/1998 |
| WO | WO-0131639 | A1 | 5/2001 |
| WO | WO-0165544 | | 9/2001 |
| WO | WO-2008007699 | A1 | 1/2008 |
| WO | WO-2009155569 | A1 | 12/2009 |

OTHER PUBLICATIONS

Ojala et al., "A Novel Pitch-Lag Search Method Using Adaptive Weighting and Median Filtering,", IEEE, 1999.*

Z. Ding et al., "How to Track Pitch Pulses in LP Residual?—Joint Time-Frequency Distribution Approach", IEEE, 2001.*

3GPP2 C.S0014-D, "Enhanced Variable Rate Codec, Speech Service Options 3, 68, 70, and 73 for Wideband Spread Spectrum Digital Systems," 3rd Generation Partnership Project 2 "3GPP2", Version 3.0, Oct. 2010.

Yoo, S.: "Speech Decomposition and Enhancement," University of Pittsburgh, 2005, Section 1.1, p. 1-3, Section 2.1.2 p. 6, Section 2.2.3 p. 10-11, Fig.2, Section 3.2, Section 5.1.1, p. 88, Para.2, Section 6.1 p. 112 Para.2.

International Search Report and Written Opinion—PCT/US2011/051039—ISA/EPO—Dec. 6, 2011.

Taiwan Search Report—TW100132894—TIPO—Dec. 13, 2013.

* cited by examiner

CODING AND DECODING A TRANSIENT FRAME

CLAIM OF PRIORITY UNDER 35 U.S.C. §119

This application claims priority to Provisional Patent Application No. 61/382,460 entitled "CODING A TRANSIENT SPEECH FRAME" filed Sep. 13, 2010, and assigned to the assignee hereof and hereby expressly incorporated by reference herein.

TECHNICAL FIELD

The present disclosure relates generally to signal processing. More specifically, the present disclosure relates to coding and decoding a transient frame.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use audio or speech signals. These electronic devices may encode speech signals for storage or transmission. For example, a cellular phone captures a user's voice or speech using a microphone. For instance, the cellular phone converts an acoustic signal into an electronic signal using the microphone. This electronic signal may then be formatted for transmission to another device (e.g., cellular phone, smart phone, computer, etc.) or for storage.

Transmitting or sending an uncompressed speech signal may be costly in terms of bandwidth and/or storage resources, for example. Some schemes exist that attempt to represent a speech signal more efficiently (e.g., using less data). However, these schemes may not represent some parts of a speech signal well, resulting in degraded performance. As can be understood from the foregoing discussion, systems and methods that improve signal coding may be beneficial.

SUMMARY

An electronic device for coding a transient frame is disclosed. The electronic device includes a processor and executable instructions stored in memory that is in electronic communication with the processor. The electronic device obtains a current transient frame. The electronic device also obtains a residual signal based on the current transient frame. The electronic device additionally determines a set of peak locations based on the residual signal. Furthermore, the electronic device determines whether to use a first coding mode or a second coding mode for coding the current transient frame based on at least the set of peak locations. The electronic device also synthesizes an excitation based on the first coding mode if the first coding mode is determined. The electronic device additionally synthesizes an excitation based on the second coding mode if the second coding mode is determined. The electronic device may also determine a plurality of scaling factors based on the excitation and the current transient frame. The first coding mode may be a "voiced transient" coding mode and the second coding mode may be an "other transient" coding mode. Determining whether to use a first coding mode or a second coding mode may be further based on a pitch lag, a previous frame type and an energy ratio.

Determining a set of peak locations may include calculating an envelope signal based on an absolute value of samples of the residual signal and a window signal and calculating a first gradient signal based on a difference between the envelope signal and a time-shifted version of the envelope signal. Determining a set of peak locations may further include calculating a second gradient signal based on a difference between the first gradient signal and a time-shifted version of the first gradient signal and selecting a first set of location indices where a second gradient signal value falls below a first threshold. Determining a set of peak locations may also include determining a second set of location indices from the first set of location indices by eliminating location indices where an envelope value falls below a second threshold relative to a largest value in the envelope and determining a third set of location indices from the second set of location indices by eliminating location indices that do not meet a difference threshold with respect to neighboring location indices.

The electronic device may also perform a linear prediction analysis using the current transient frame and a signal prior to the current transient frame to obtain a set of linear prediction coefficients and determine a set of quantized linear prediction coefficients based on the set of linear prediction coefficients. Obtaining the residual signal may be further based on the set of quantized linear prediction coefficients.

Determining whether to use the first coding mode or the second coding mode may include determining an estimated number of peaks and selecting the first coding mode if a number of peak locations is greater than or equal to the estimated number of peaks. Determining whether to use the first coding mode or the second coding mode may additionally include selecting the first coding mode if a last peak in the set of peak locations is within a first distance from an end of the current transient frame and a first peak in the set of peak locations is within a second distance from a start of the current transient frame. Determining whether to use the first coding mode or the second coding mode may additionally include selecting the second coding mode if an energy ratio between a previous frame and the current transient frame is outside of a predetermined range and selecting the second coding mode if a frame type of the previous frame is unvoiced or silence. The first distance may be determined based on a pitch lag and the second distance may be determined based on the pitch lag.

Synthesizing an excitation based on the first coding mode may include determining a location of a last peak in the current transient frame based on a last peak location in a previous frame and a pitch lag of the current transient frame. Synthesizing an excitation based on the first coding mode may also include synthesizing the excitation between a last sample of the previous frame and a first sample location of the last peak in the current transient frame using waveform interpolation using a prototype waveform that is based on the pitch lag and a spectral shape.

Synthesizing an excitation based on the second coding mode may include synthesizing the excitation by repeatedly placing a prototype waveform starting at a first location. The first location may be determined based on a first peak location from the set of peak locations. The prototype waveform may be based on a pitch lag and a spectral shape and the prototype waveform may be repeatedly placed a number of times that is based on the pitch lag, the first location and a frame size.

An electronic device for decoding a transient frame is also disclosed. The electronic device includes a processor and executable instructions stored in memory that is in electronic communication with the processor. The electronic device obtains a frame type, and if the frame type indicates a transient frame, then the electronic device obtains a transient coding mode parameter and determines whether to use a first coding mode or a second coding mode based on the transient coding mode parameter. If the frame type indicates a transient frame, the electronic device also synthesizes an excitation based on the first coding mode if it is determined to use the first coding mode and synthesizes an excitation based on the second coding mode if it is determined to use the second coding mode. The electronic device may also obtain a pitch lag parameter and determine a pitch lag based on the pitch lag parameter. The electronic device may also obtain a plurality of scaling factors and scale the excitation based on the plurality of scaling factors.

The electronic device may also obtain a quantized linear prediction coefficients parameter and determine a set of quantized linear prediction coefficients based on the quantized linear prediction coefficients parameter. The electronic device may also generate a synthesized speech signal based on the excitation signal and the set of quantized linear prediction coefficients.

Synthesizing the excitation based on the first coding mode may include determining a location of a last peak in a current transient frame based on a last peak location in a previous frame and a pitch lag of the current transient frame. Synthesizing the excitation based on the first coding mode may also include synthesizing the excitation between a last sample of the previous frame and a first sample location of the last peak in the current transient frame using waveform interpolation using a prototype waveform that is based on the pitch lag and a spectral shape.

Synthesizing an excitation based on the second coding mode may include obtaining a first peak location and synthesizing the excitation by repeatedly placing a prototype waveform starting at a first location. The first location may be determined based on the first peak location. The prototype waveform may be based on the pitch lag and a spectral shape and the prototype waveform may be repeatedly placed a number of times that is based on a pitch lag, the first location and a frame size.

A method for coding a transient frame on an electronic device is also disclosed. The method includes obtaining a current transient frame. The method also includes obtaining a residual signal based on the current transient frame. The method further includes determining a set of peak locations based on the residual signal. The method additionally includes determining whether to use a first coding mode or a second coding mode for coding the current transient frame based on at least the set of peak locations. Furthermore, the method includes synthesizing an excitation based on the first coding mode if the first coding mode is determined. The method also includes synthesizing an excitation based on the second coding mode if the second coding mode is determined.

A method for decoding a transient frame on an electronic device is also disclosed. The method includes obtaining a frame type. If the frame type indicates a transient frame, the method also includes obtaining a transient coding mode parameter and determining whether to use a first coding mode or a second coding mode based on the transient coding mode parameter. If the frame type indicates a transient frame, the method also includes synthesizing an excitation based on the first coding mode if it is determined to use the first coding mode and synthesizing an excitation based on the second coding mode if it is determined to use the second coding mode.

A computer-program product for coding a transient frame is also disclosed. The computer-program product includes a non-transitory tangible computer-readable medium with instructions. The instructions include code for causing an electronic device to obtain a current transient frame. The instructions also include code for causing the electronic device to obtain a residual signal based on the current transient frame. The instructions additionally include code for causing the electronic device to determine a set of peak locations based on the residual signal. The instructions further include code for causing the electronic device to determine whether to use a first coding mode or a second coding mode for coding the current transient frame based on at least the set of peak locations. The instructions also include code for causing the electronic device to synthesize an excitation based on the first coding mode if the first coding mode is determined. Furthermore, the instructions include code for causing the electronic device to synthesize an excitation based on the second coding mode if the second coding mode is determined.

A computer-program product for decoding a transient frame is also disclosed. The computer-program product includes a non-transitory tangible computer-readable medium with instructions. The instructions include code for causing an electronic device to obtain a frame type. If the frame type indicates a transient frame, then the instructions also include code for causing the electronic device to obtain a transient coding mode parameter and code for causing the electronic device to determine whether to use a first coding mode or a second coding mode based on the transient coding mode parameter. If the frame type indicates a transient frame, the instructions additionally include code for causing the electronic device to synthesize an excitation based on the first coding mode if it is determined to use the first coding mode and code for causing the electronic device to synthesize an excitation based on the second coding mode if it is determined to use the second coding mode.

An apparatus for coding a transient frame is also disclosed. The apparatus includes means for obtaining a current transient frame. The apparatus also includes means for obtaining a residual signal based on the current transient frame. The apparatus further includes means for determining a set of peak locations based on the residual signal. Additionally, the apparatus includes means for determining whether to use a first coding mode or a second coding mode for coding the current transient frame based on at least the set of peak locations. The apparatus further includes means for synthesizing an excitation based on the first coding mode if the first coding mode is determined. The apparatus also includes means for synthesizing an excitation based on the second coding mode if the second coding mode is determined.

An apparatus for decoding a transient frame is also disclosed. The apparatus includes means for obtaining a frame type. If the frame type indicates a transient frame the apparatus also includes means for obtaining a transient coding mode parameter and means for determining whether to use a first coding mode or a second coding mode based on the transient coding mode parameter. If the frame type indicates a transient frame, the apparatus further includes means for synthesizing an excitation based on the first coding mode if it is determined to use the first coding mode and means for synthesizing an excitation based on the second coding mode if it is determined to use the second coding mode.

DETAILED DESCRIPTION

Figure 1:
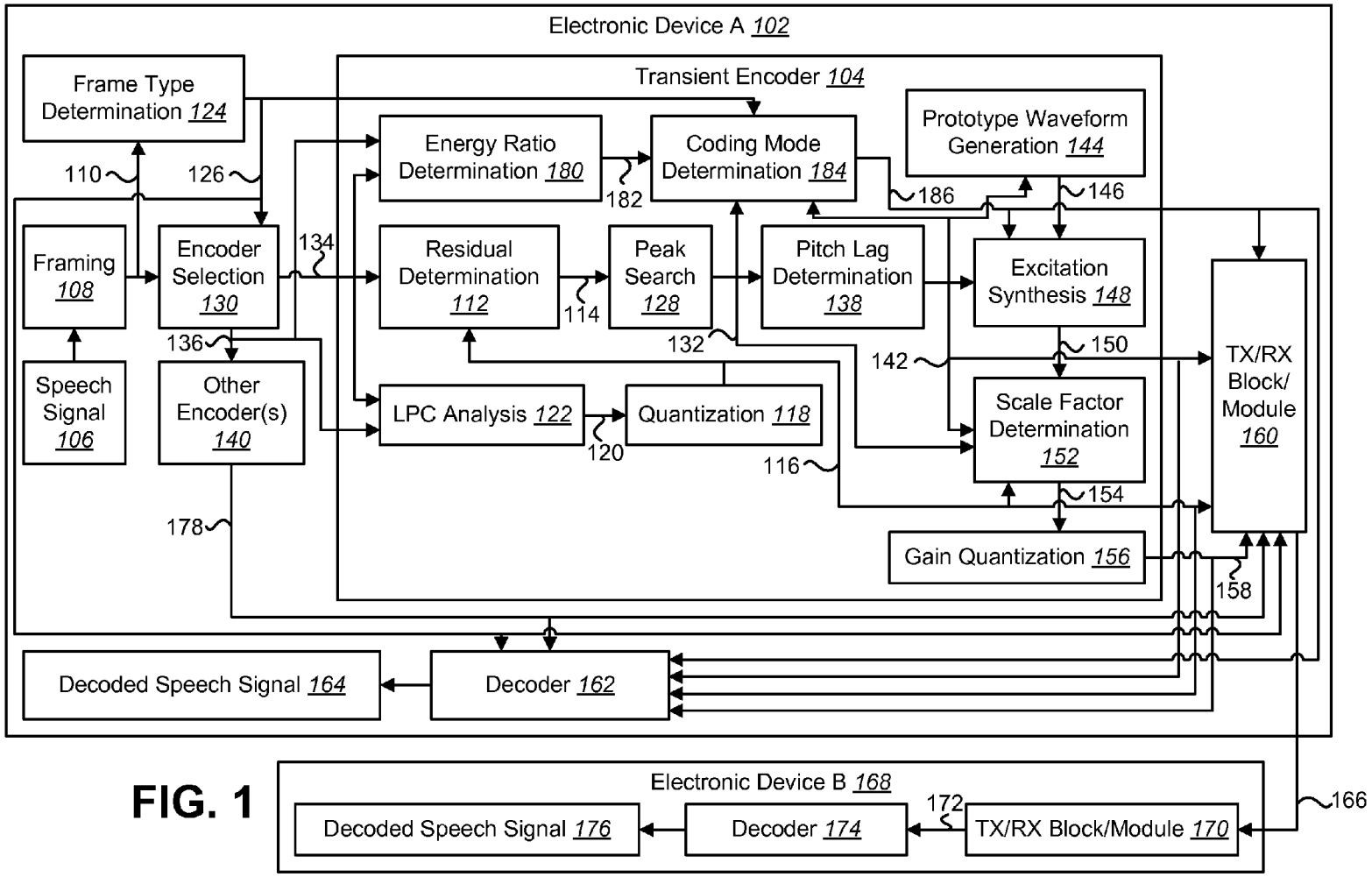
FIG. 1 is a block diagram illustrating one configuration of an electronic device in which systems and methods for coding a transient frame may be implemented.

The systems and methods disclosed herein may be applied to a variety of electronic devices. Examples of electronic devices include voice recorders, video cameras, audio players (e.g., Moving Picture Experts Group-1 (MPEG-1) or MPEG-2 Audio Layer 3 (MP3) players), video players, audio recorders, desktop computers/laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers.

An electronic device or communication device may operate in accordance with certain industry standards, such as International Telecommunication Union (ITU) standards and/or Institute of Electrical and Electronics Engineers (IEEE) standards (e.g., Wireless Fidelity or "Wi-Fi" standards such as 802.11a, 802.11b, 802.11g, 802.11n and/or 802.11ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate wirelessly and/or may communicate using a wired connection or link. For example, some communication devices may communicate with other devices using an Ethernet protocol. The systems and methods disclosed herein may be applied to communication devices that communicate wirelessly and/or that communicate using a wired connection or link. In one configuration, the systems and methods disclosed herein may be applied to a communication device that communicates with another device using a satellite.

The systems and methods disclosed herein may be applied to one example of a communication system that is described as follows. In this example, the systems and methods disclosed herein may provide low bitrate (e.g., 2 kilobits per second (Kbps)) speech encoding for geo-mobile satellite air interface (GMSA) satellite communication. More specifically, the systems and methods disclosed herein may be used in integrated satellite and mobile communication networks. Such networks may provide seamless, transparent, interoperable and ubiquitous wireless coverage. Satellite-based service may be used for communications in remote locations where terrestrial coverage is unavailable. For example, such service may be useful for man-made or natural disasters, broadcasting and/or fleet management and asset tracking. L and/or S-band (wireless) spectrum may be used.

In one configuration, a forward link may use 1×Evolution Data Optimized (EV-DO) Rev A air interface as the base technology for the over-the-air satellite link. A reverse link may use frequency-division multiplexing (FDM). For example, a 1.25 megahertz (MHz) block of reverse link spectrum may be divided into 192 narrowband frequency channels, each with a bandwidth of 6.4 kilohertz (kHz). The reverse link data rate may be limited. This may present a need for low bit rate encoding. In some cases, for example, a channel may be able to only support 2.4 Kbps. However, with better channel conditions, 2 FDM channels may be available, possibly providing a 4.8 Kbps transmission.

On the reverse link, for example, a low bit rate speech encoder may be used. This may allow a fixed rate of 2 Kbps for active speech for a single FDM channel assignment on the reverse link. In one configuration, the reverse link uses a ¼ convolution coder for basic channel coding.

In some configurations, the systems and methods disclosed herein may be used in addition to or alternatively from other coding modes. For example, the systems and methods disclosed herein may be used in addition to or alternatively from quarter rate voiced coding using prototype pitch-period waveform interpolation. In prototype pitch-period waveform interpolation (PPPWI), a prototype waveform may be used to generate interpolated waveforms that may replace actual waveforms, allowing a reduced number of samples to produce a reconstructed signal. PPPWI may be available at full rate or quarter rate and/or may produce a time-synchronous output, for example. Furthermore, quantization may be performed in the frequency domain in PPPWI. QQQ may be used in a voiced encoding mode (instead of FQQ (effective half rate), for example). QQQ is a coding pattern that encodes three consecutive voiced frames using quarter-rate prototype pitch period waveform interpolation (QPPP-WI) at 40 bits per frame (2 kilobits per second (kbps) effectively). FQQ is a coding pattern in which three consecutive voiced frames are encoded using full rate PPP, QPPP and QPPP respectively. This achieves an average rate of 4 kbps. The latter may not be used in a 2 kbps vocoder. It should be noted that quarter rate prototype pitch period (QPPP) may be used in a modified fashion, with no delta encoding of amplitudes of prototype representation in the frequency domain and with 13-bit line spectral frequency (LSF) quantization. In one configuration, QPPP may use 13 bits for LSFs, 12 bits for a prototype waveform amplitude, six bits for prototype waveform power, seven bits for pitch lag and two bits for mode, resulting in 40 bits total.

In particular, the systems and method disclosed herein may be used for a transient encoding mode (which may provide seed needed for QPPP). This transient encoding mode (in a 2 Kbps vocoder, for example) may use a unified model for coding up transients, down transients and voiced transients.

The systems and method disclosed herein describe coding one or more transient audio or speech frames. In one configuration, the systems and methods disclosed herein may use analysis of peaks in a residual signal and determination of a suitable coding model for placement of peaks in the excitation and linear predictive coding (LPC) filtering of the synthesized excitation.

Coding transient frames in a speech signal at very low bit rates is one challenge in speech coding. Transient frames may typically mark the start or the end of a new speech event. Such frames occur at the junction of unvoiced and voiced speech. Sometimes transient frames may include plosives and other short speech events. The speech signal in a transient frame may therefore be non-stationary, which causes the traditional coding methods to perform unsatisfactorily while coding such frames. For example, many traditional approaches use the same methodology to code a transient frame that is used for regular voiced frames. This may cause inefficient coding of transient frames. The systems and methods disclosed herein may improve the coding of transient frames.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of an electronic device 102 in which systems and methods for coding a transient frame may be implemented. Additionally or alternatively, systems and methods for decoding a transient frame may be implemented in the electronic device 102. Electronic device A 102 may include a transient encoder 104. One example of the transient encoder 104 is a Linear Predictive Coding (LPC) encoder. The transient encoder 104 may be used by electronic device A 102 to encode a speech (or audio) signal 106. For instance, the transient encoder 104 encodes transient frames of a speech signal 106 into a "compressed" format by estimating or generating a set of parameters that may be used to synthesize the speech signal 106. In one configuration, such parameters may represent estimates of pitch (e.g., frequency), amplitude and formants (e.g., resonances) that can be used to synthesize the speech signal 106.

Electronic device A 102 may obtain a speech signal 106. In one configuration, electronic device A 102 obtains the speech signal 106 by capturing and/or sampling an acoustic signal using a microphone. In another configuration, electronic device A 102 receives the speech signal 106 from another device (e.g., a Bluetooth headset, a Universal Serial Bus (USB) drive, a Secure Digital (SD) card, a network interface, wireless microphone, etc.). The speech signal 106 may be provided to a framing block/module 108. As used herein, the term "block/module" may be used to indicate that a particular element may be implemented in hardware, software or a combination of both.

Electronic device A 102 may segment the speech signal 106 into one or more frames 110 (e.g., a sequence of frames 110) using the framing block/module 108. For instance, a frame 110 may include a particular number of speech signal 106 samples and/or include an amount of time (e.g., 10-20 milliseconds) of the speech signal 106. When the speech signal 106 is segmented into frames 110, the frames 110 may be classified according to the signal that they contain. For example, a frame 110 may be provided to a frame type determination block/module 124, which may determine whether the frame 110 is a voiced frame, an unvoiced frame, a silent frame or a transient frame. In one configuration, the systems and methods disclosed herein may be used to encode transient frames.

A transient frame, for example, may be situated on the boundary between one speech class and another speech class. For instance, a speech signal 106 may transition from an unvoiced sound (e.g., f, s, sh, th, etc.) to a voiced sound (e.g., a, e, i, o, u, etc.). Some transient types include up transients (when transitioning from an unvoiced to a voiced part of a speech signal 106, for example), plosives, voiced transients (e.g., Linear Predictive Coding (LPC) changes and pitch lag variations) and down transients (when transitioning from a voiced to an unvoiced or silent part of a speech signal 106 such as word endings, for example). A frame 110 in-between the two speech classes may be a transient frame. Furthermore, transient frames may be further classified as voiced transient frames or other transient frames. The systems and methods disclosed herein may be beneficially applied to transient frames.

The frame type determination block/module 124 may provide a frame type 126 to an encoder selection block/module 130 and a coding mode determination block/module 184. Additionally or alternatively, the frame type 126 may be provided to a transmit (TX) and/or receive (RX) block/module 160 for transmission to another device (e.g., electronic device B 168) and/or may be provided to a decoder 162. The encoder selection block/module 130 may select an encoder to code the frame 110. For example, if the frame type 126 indicates that the frame 110 is transient, then the encoder selection block/module 130 may provide the transient frame 134 to the transient encoder 104. However, if the frame type 126 indicates that the frame 110 is another kind of frame 136 that is not transient (e.g., voiced, unvoiced, silent, etc.), then the encoder selection block/module 130 may provide the other frame 136 to another encoder 140. It should be noted that the encoder selection block/module 130 may thus generate a sequence of transient frames 134 and/or other frames 136. Thus, one or more previous frames 134, 136 may be provided by the encoder selection block/module 130 in addition to a current transient frame 134. In one configuration, electronic device A 102 may include one or more other encoders 140. More detail about these other encoders is given below.

The transient encoder 104 may use a linear predictive coding (LPC) analysis block/module 122 to perform a linear prediction analysis (e.g., LPC analysis) on a transient frame 134. It should be noted that the LPC analysis block/module 122 may additionally or alternatively use one or more samples from a previous frame 110. For example, in the case that the previous frame 110 is a transient frame 134, the LPC analysis block/module 122 may use one or more samples from the previous transient frame 134. Furthermore, if the previous frame 110 is another kind of frame (e.g., voiced, unvoiced, silent, etc.) 136, the LPC analysis block/module 122 may use one or more samples from the previous other frame 136.

The LPC analysis block/module 122 may produce one or more LPC coefficients 120. Examples of LPC coefficients 120 include line spectral frequencies (LSFs) and line spectral pairs (LSPs). The LPC coefficients 120 may be provided to a quantization block/module 118, which may produce one or more quantized LPC coefficients 116. The quantized LPC coefficients 116 and one or more samples from one or more transient frames 134 may be provided to a residual determination block/module 112, which may be used to determine a residual signal 114. For example, a residual signal 114 may include a transient frame 134 of the speech signal 106 that has had the formants or the effects of the formants (e.g., coefficients) removed from the speech signal 106. The residual signal 114 may be provided to a peak search block/module 128.

The peak search block/module 128 may search for peaks in the residual signal 114. In other words, the transient encoder 104 may search for peaks (e.g., regions of high energy) in the residual signal 114. These peaks may be identified to obtain a list or set of peaks 132 that includes one or more peak locations. Peak locations in the list or set of peaks 132 may be specified in terms of sample number and/or time, for example. More detail on obtaining the list or set of peaks 132 is given below.

The set of peaks 132 may be provided to the coding mode determination block/module 184, a pitch lag determination block/module 138 and/or a scale factor determination block/module 152. The pitch lag determination block/module 138 may use the set of peaks 132 to determine a pitch lag 142. A "pitch lag" may be a "distance" between two successive pitch spikes in a transient frame 134. A pitch lag 142 may be specified in a number of samples and/or an amount of time, for example. In some configurations, the pitch lag determination block/module 138 may use the set of peaks 132 or a set of pitch lag candidates (which may be the distances between the peaks 132) to determine the pitch lag 142. For example, the pitch lag determination block/module 138 may use an averaging or smoothing algorithm to determine the pitch lag 142 from a set of candidates. Other approaches may be used. The pitch lag 142 determined by the pitch lag determination block/module 138 may be provided to the coding mode determination block/module 184, an excitation synthesis block/module 148 and/or a scale factor determination block/module 152.

The coding mode determination block/module 184 may determine a coding mode (indicator or parameter) 186 for a transient frame 134. In one configuration, the coding mode determination block/module 184 may determine whether to use a first coding mode for a transient frame 134 or a second coding mode for a transient frame 134. For instance, the coding mode determination block/module 184 may determine whether the transient frame 134 is a voiced transient frame or other transient frame. The coding mode determination block/module 184 may use one or more kinds of information to make this determination. For example, the coding mode determination block/module 184 may use a set of peaks 132, a pitch lag 142, an energy ratio 182, a frame type 126 and/or other information to make this determination. The energy ratio 182 may be determined by an energy ratio determination block/module 180 based on an energy ratio between a previous frame and a current transient frame 134. The previous frame may be a transient frame 134 or another kind of frame 136 (e.g., silence, voiced, unvoiced, etc.). Thus, the transient encoder block/module 104 may identify regions of importance in the transient frame 134. It should be noted that these regions may be identified since a transient frame 134 may not be very uniform and/or stationary. In general, the transient encoder 104 may identify a set of peaks 132 in the residual signal 114 and use the peaks 132 to determine a coding mode 186. The selected coding mode 186 may then be used to "encode" or "synthesize" the speech signal in the transient frame 134.

The coding mode determination block/module 184 may generate a coding mode 186 that indicates a selected coding mode 186 for transient frames 134. For example, the coding mode 186 may indicate a first coding mode if the current transient frame is a "voiced transient" frame or may indicate a second coding mode if the current transient frame is an "other transient" frame. The coding mode 186 may be sent (e.g., provided) to the excitation synthesis block/module 148, to storage, to a (local) decoder 162 and/or to a remote decoder 174. For example, the coding mode 186 may be provided to the TX/RX block/module 160, which may format and send the coding mode 186 to electronic device B 168, where it may be provided to a decoder 174.

The excitation synthesis block/module 148 may generate or synthesize an excitation 150 based on the coding mode 186, the pitch lag 142 and a prototype waveform 146 provided by a prototype waveform generation block/module 144. The prototype waveform generation block/module 144 may generate the prototype waveform 146 based on a spectral shape and/or a pitch lag 142. The excitation 150, the set of peaks 132, the pitch lag 142 and/or the quantized LPC coefficients 116 may be provided to a scale factor determination block/module 152, which may produce a set of gains (e.g., scaling factors) 154 based on the excitation 150, the set of peaks 132, the pitch lag 142 and/or the quantized LPC coefficients 116. The set of gains 154 may be provided to a gain quantization block/module 156 that quantizes the set of gains 154 to produce a set of quantized gains 158.

In one configuration, a transient frame may be decoded using the pitch lag 142, the quantized LPC coefficients 116, the quantized gains 158, the frame type 126 and/or the coding mode 186 in order to produce a decoded speech signal. The pitch lag 142, the quantized LPC coefficients 116, the quantized gains 158, the frame type 126 and/or the coding mode 186 may be transmitted to another device, stored and/or decoded.

In one configuration, electronic device A 102 may include a transmit (TX) and/or receive (RX) block/module 160. In a case where the current frame 110 is not a transient frame 134, but is some other kind of frame 136, another encoder 140 (e.g., silence encoder, quarter-rate prototype pitch period (QPPP) encoder, noise excited linear prediction (NELP) encoder, etc.) may be used to encode the frame 136. The other encoder 140 may produce an encoded non-transient speech signal 178, which may be provided to the TX/RX block/module 160. A frame type 126 may also be provided to the TX/RX block/module 160. The TX/RX block/module 160 may format the encoded non-transient speech signal 178 and the frame type 126 into one or more messages 166 for transmission to another device, such as electronic device B 168. The one or more messages 166 may be transmitted using a wireless and/or wired connection or link. In some configurations, the one or more messages 166 may be relayed by satellite, base station, routers, switches and/or other devices or mediums to electronic device B 168. Electronic device B 168 may receive the one or more messages 166 using a TX/RX block/module 170 and de-format the one or more messages 166 to produce speech signal information 172. For example, the TX/RX block/module 170 may demodulate, decode (not to be confused with speech signal decoding provided by the decoder 174) and/or otherwise de-format the one or more messages 166. In the case that the current frame is not a transient frame 134, the speech signal information 172 may include an encoded non-transient speech signal and a frame type parameter.

Electronic device B 168 may include a decoder 174. The decoder 174 may include one or more types of decoders, such as a decoder for silent frames (e.g., a silence decoder), a decoder for unvoiced frames (e.g., a noise excited linear prediction (NELP) decoder), a transient decoder and/or a decoder for voiced frames (e.g., a quarter rate prototype pitch period (QPPP) decoder). The frame type parameter in the speech signal information 172 may be used to determine which decoder (included in the decoder 174) to use. In the case where the current frame 110 is not a transient frame 134, the decoder 174 may decode the encoded non-transient speech signal to produce a decoded speech signal 176 that may be output (using a speaker, for example), stored in memory and/or transmitted to another device (e.g., a Bluetooth headset, etc.).

In one configuration, electronic device A 102 may include a decoder 162. In a case where the current frame 110 is not a transient frame 134, but is some other kind of frame 136, another encoder 140 may produce an encoded non-transient speech signal 178, which may be provided to the decoder 162. A frame type 126 may also be provided to the decoder 162. The decoder 162 may include one or more types of decoders, such as a decoder for silent frames (e.g., a silence decoder), a decoder for unvoiced frames (e.g., a noise excited linear prediction (NELP) decoder), a transient decoder and/or a decoder for voiced frames (e.g., a quarter rate prototype pitch period (QPPP) decoder). The frame type 126 may be used to determine which decoder (included in the decoder 162) to use. In the case where the current frame 110 is not a transient frame 134, the decoder 162 may decode the encoded non-transient speech signal 178 to produce a decoded speech signal 164 that may be output (using a speaker, for example), stored in memory and/or transmitted to another device (e.g., a Bluetooth headset, etc.).

In a configuration where electronic device A 102 includes a TX/RX block/module 160 and in the case where the current frame 110 is a transient frame 134, several parameters may be provided to the TX/RX block/module 160. For example, the pitch lag 142, the quantized LPC coefficients 116, the quantized gains 158, the frame type 126 and/or the coding mode 186 may be provided to the TX/RX block/module 160. The TX/RX block/module 160 may format the pitch lag 142, the quantized LPC coefficients 116, the quantized gains 158, the frame type 126 and/or the coding mode 186 into a format suitable for transmission. For example, the TX/RX block/module 160 may encode (not to be confused with transient frame encoding provided by the transient encoder 104), modulate, scale (e.g., amplify) and/or otherwise format the pitch lag 142, the quantized LPC coefficients 116, the quantized gains 158, the frame type 126 and/or the coding mode 186 as one or more messages 166. The TX/RX block/module 160 may transmit the one or more messages 166 to another device, such as electronic device B 168. The one or more messages 166 may be transmitted using a wireless and/or wired connection or link. In some configurations, the one or more messages 166 may be relayed by satellite, base station, routers, switches and/or other devices or mediums to electronic device B 168.

Electronic device B 168 may receive the one or more messages 166 transmitted by electronic device A 102 using a TX/RX block/module 170. The TX/RX block/module 170 may channel decode (not to be confused with speech signal decoding), demodulate and/or otherwise deformat the one or more received messages 166 to produce speech signal information 172. In the case that the current frame is a transient frame, the speech signal information 172 may comprise, for example, a pitch lag, quantized LPC coefficients, quantized gains, a frame type parameter and/or a coding mode parameter. The speech signal information 172 may be provided to a decoder 174 (e.g., an LPC decoder) that may produce (e.g., decode) a decoded (or synthesized) speech signal 176. The decoded speech signal 176 may be converted to an acoustic signal (e.g., output) using a transducer (e.g., speaker), stored in memory and/or transmitted to another device (e.g., Bluetooth headset).

In another configuration, the pitch lag 142, the quantized LPC coefficients 116, the quantized gains 158, the frame type 126 and/or the coding mode 186 may be provided to a decoder 162 (on electronic device A 102). The decoder 162 may use the pitch lag 142, the quantized LPC coefficients 116, the quantized gains 158, the frame type 126 and/or the coding mode 186 to produce a decoded speech signal 164. The decoded speech signal 164 may be output using a speaker, stored in memory and/or transmitted to another device, for example. For instance, electronic device A 102 may be a digital voice recorder that encodes and stores speech signals 106 in memory, which may then be decoded to produce a decoded speech signal 164. The decoded speech signal 164 may then be converted to an acoustic signal (e.g., output) using a transducer (e.g., speaker). The decoder 162 on electronic device A 102 and the decoder 174 on electronic device B 168 may perform similar functions.

Several points should be noted. The decoder 162 illustrated as included in electronic device A 102 may or may not be included and/or used depending on the configuration. Furthermore, electronic device B 168 may or may not be used in conjunction with electronic device A 102. Furthermore, although several parameters or kinds of information 186, 142, 116, 158, 126 are illustrated as being provided to the TX/RX block/module 160 and/or to the decoder 162, these parameters or kinds of information 186, 142, 116, 158, 126 may or may not be stored in memory before being sent to the TX/RX block/module 160 and/or the decoder 162.

Figure 2:
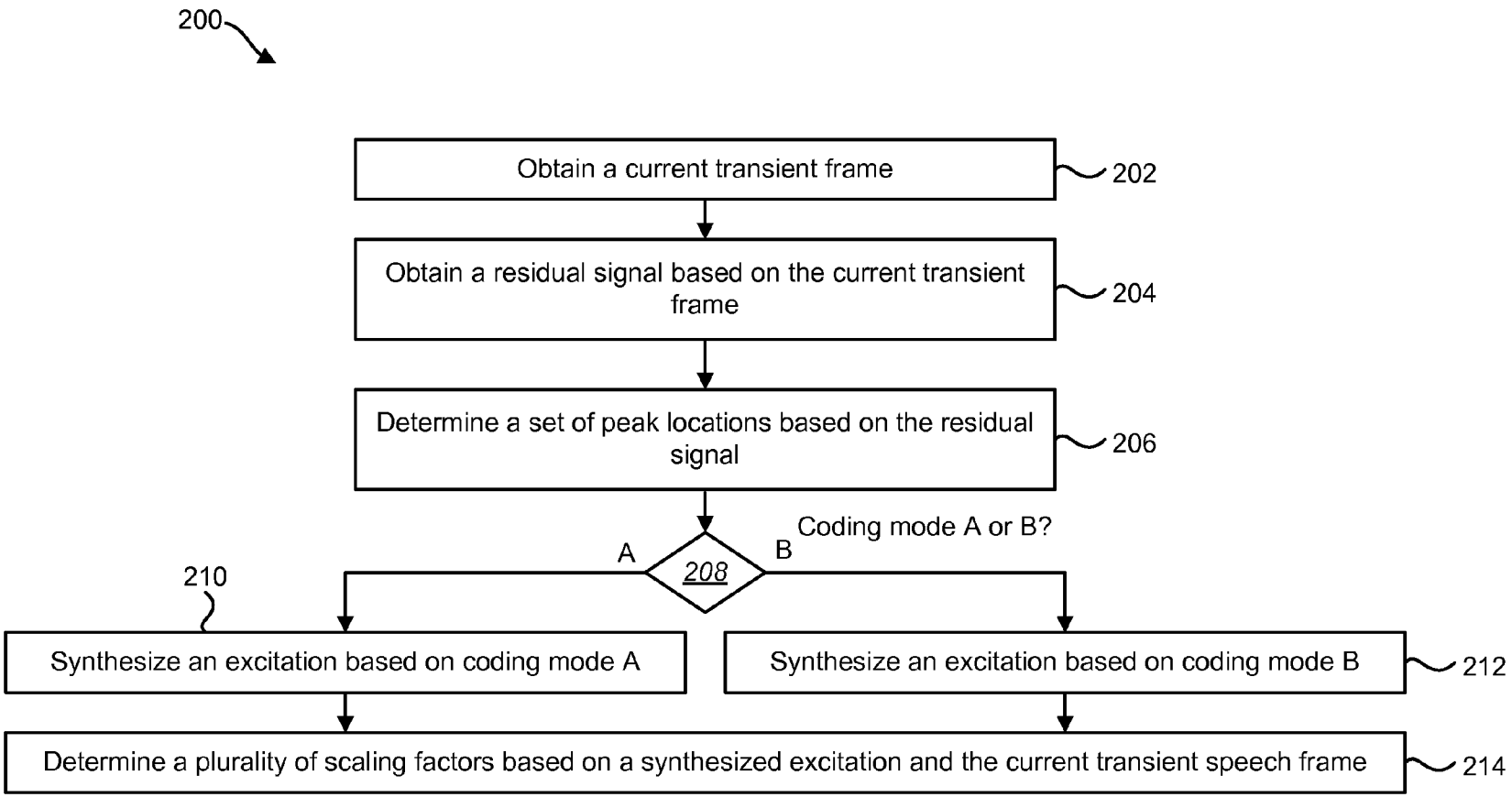
FIG. 2 is a flow diagram illustrating one configuration of a method for coding a transient frame.

FIG. 2 is a flow diagram illustrating one configuration of a method 200 for coding a transient frame. For example, an electronic device 102 may perform the method 200 illustrated in FIG. 2 in order to code a transient frame 134 of a speech signal 106. An electronic device 102 may obtain 202 a current transient frame 134. In one configuration, the electronic device 102 may obtain an electronic speech signal 106 by capturing an acoustic speech signal using a microphone. Additionally or alternatively, the electronic device 102 may receive the speech signal 106 from another device. The electronic device 102 may then segment the speech signal 106 into one or more frames 110. One example of a frame 110 may include a certain number of samples or a given amount of time (e.g., 10-20 milliseconds) of the speech signal 106. The electronic device 102 may obtain 202 the current transient frame 134, for example, when it 102 determines that the current frame 110 is a transient frame 134. This may be done using a frame type determination block/module 124, for instance.

The electronic device 102 may obtain 204 a residual signal 114 based on the current transient frame 134. For example, the electronic device 102 may remove the effects of the LPC coefficients 116 (e.g., formants) from the current transient frame 134 to obtain 202 the residual signal 114.

The electronic device 102 may determine 206 a set of peak locations 132 based on the residual signal 114. For example, the electronic device 102 may search the LPC residual signal 114 to determine 206 the set of peak locations 132. A peak location may be described in terms of time and/or sample number, for example.

The electronic device 102 may determine 208 whether to use a first coding mode (e.g., "coding mode A") or a second coding mode (e.g., "coding mode B") for coding the current transient frame 134. This determination may be based on, for example, the set of peak locations 132, a pitch lag 142, a previous frame type 126 (e.g., voiced, unvoiced, silent, transient) and/or an energy ratio 182 between the previous frame 110 (which may be a transient frame 134 or other frame 136) and the current transient frame 134. In one configuration, the first coding mode may be a voiced transient coding mode and the second coding mode may be an "other transient" coding mode.

If the first coding mode (e.g., coding mode A) is determined 208 or selected, the electronic device 102 may synthesize 210 an excitation 150 based on the first coding mode (e.g., coding mode A) for the current transient frame 134. In other words, the electronic device 102 may synthesize 210 an excitation 150 in response to the coding mode selected.

If the second coding mode (e.g., coding mode B) is determined 208 or selected, the electronic device 102 may synthesize 212 an excitation 150 based on the second coding mode (e.g., coding mode B) for the current transient frame 134. In other words, the electronic device 102 may synthesize 212 an excitation 150 in response to the coding mode selected. The electronic device 102 may determine 214 a plurality of scaling factors (e.g., gains) 154 based on the synthesized excitation 150 and/or the (current) transient frame 134. It should be noted that the scaling factors 154 may be determined 214 regardless of the transient coding mode selected.

Figure 3:
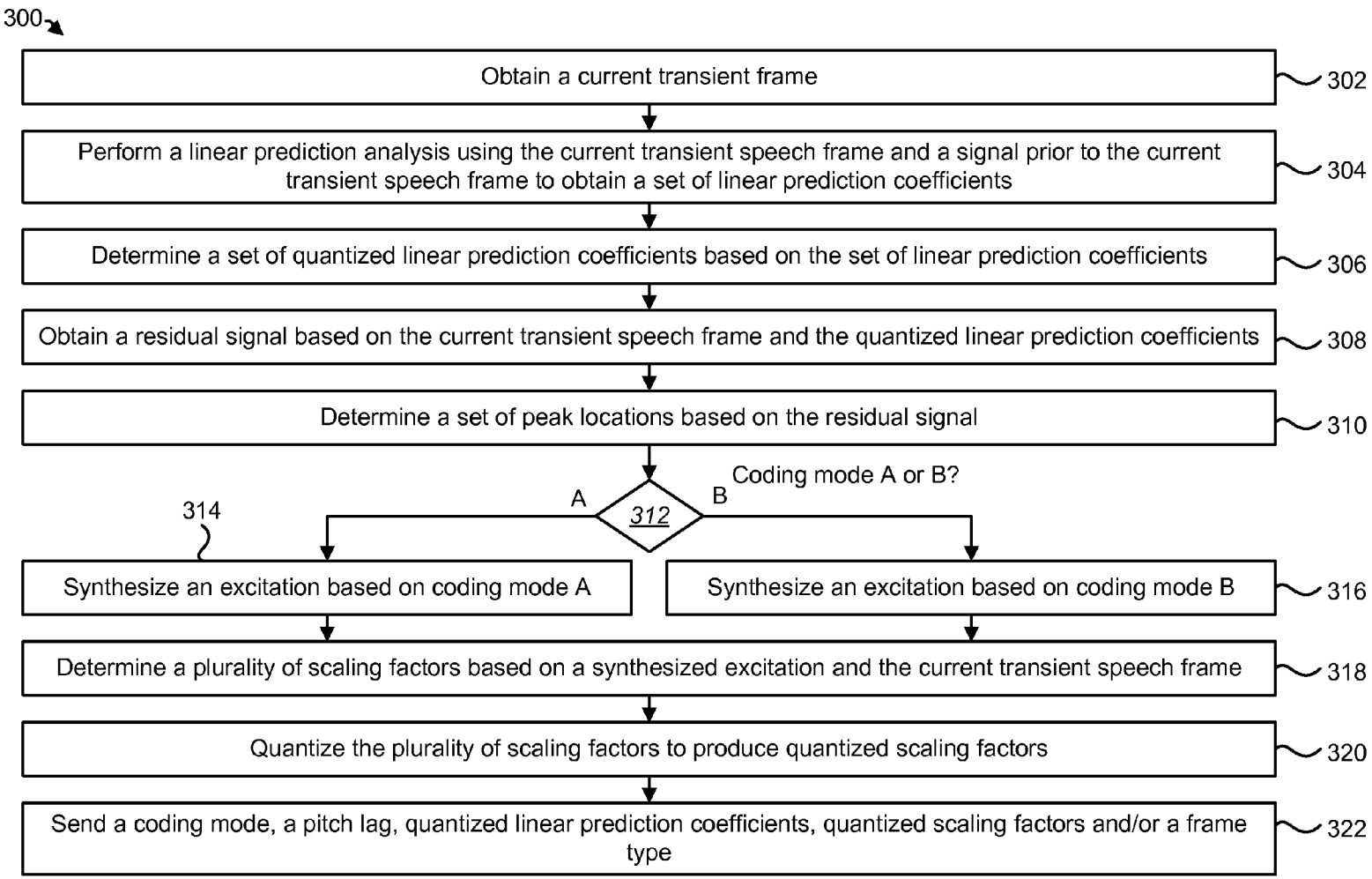
FIG. 3 is a flow diagram illustrating a more specific configuration of a method for coding a transient frame.

FIG. 3 is a flow diagram illustrating a more specific configuration of a method 300 for coding a transient frame. For example, an electronic device 102 may perform the method 300 illustrated in FIG. 3 in order to code a transient frame 134 of a speech signal 106. An electronic device 102 may obtain 302 a current transient frame 134. In one configuration, the electronic device 102 may obtain an electronic speech signal 106 by capturing an acoustic speech signal using a microphone. Additionally or alternatively, the electronic device 102 may receive the speech signal 106 from another device. The electronic device 102 may then segment the speech signal 106 into one or more frames 110. One example of a frame 110 may include a certain number of samples or a given amount of time (e.g., 10-20 milliseconds) of the speech signal 106. The electronic device 102 may obtain 302 the current transient frame 134, for example, when it 102 determines that the current frame 110 is a transient frame 134. This may be done using a frame type determination block/module 124, for instance.

The electronic device 102 may perform 304 a linear prediction analysis using the current transient frame 134 and a signal prior to the current transient frame 134 to obtain a set of linear prediction (e.g., LPC) coefficients 120. For example, the electronic device 102 may use a look-ahead buffer and a buffer containing at least one sample of the speech signal 106 prior to the current transient frame 134 to obtain the LPC coefficients 120.

The electronic device 102 may determine 306 a set of quantized linear prediction (e.g., LPC) coefficients 116 based on the set of LPC coefficients 120. For example, the electronic device 102 may quantize the set of LPC coefficients 120 to determine 306 the set of quantized LPC coefficients 116.

The electronic device 102 may obtain 308 a residual signal 114 based on the current transient frame 134 and the quantized LPC coefficients 116. For example, the electronic device 102 may remove the effects of the LPC coefficients 116 (e.g., formants) from the current transient frame 134 to obtain 308 the residual signal 114.

The electronic device 102 may determine 310 a set of peak locations 132 based on the residual signal 114. For example, the electronic device 102 may search the LPC residual signal 114 to determine the set of peak locations 132. A peak location may be described in terms of time and/or sample number, for example.

In one configuration, the electronic device 102 may determine 310 the set of peak locations as follows. The electronic device 102 may calculate an envelope signal based on the absolute value of samples of the (LPC) residual signal 114 and a predetermined window signal. The electronic device 102 may then calculate a first gradient signal based on a difference between the envelope signal and a time-shifted version of the envelope signal. The electronic device 102 may calculate a second gradient signal based on a difference between the first gradient signal and a time-shifted version of the first gradient signal. The electronic device 102 may then select a first set of location indices where a second gradient signal value falls below a predetermined negative (first) threshold. The electronic device 102 may also determine a second set of location indices from the first set of location indices by eliminating location indices where an envelope value falls below a predetermined (second) threshold relative to the largest value in the envelope. For example, if the envelope value at a given peak location falls below 10% of the largest value in the envelope, then that peak location is eliminated from the list. Additionally, the electronic device 102 may determine a third set of location indices from the second set of location indices by eliminating location indices that are not a pre-determined difference threshold with respect to neighboring location indices. One example of the difference threshold is the estimated pitch lag value. In other words, if two peaks are not within pitch_lag±delta, then the peak whose envelope value is smaller is eliminated. The location indices (e.g., the first, second and/or third set) may correspond to the location of the determined set of peaks.

The electronic device 102 may determine 312 whether to use a first coding mode (e.g., "coding mode A") or a second coding mode (e.g., "coding mode B") for coding the current transient frame 134. This determination may be based on, for example, the set of peak locations 132, a pitch lag 142, a previous frame type 126 (e.g., voiced, unvoiced, silent, transient) and/or an energy ratio 182 between the previous frame 110 (which may be a transient frame 134 or other frame 136) and the current transient frame 134.

In one configuration, the electronic device 102 may determine 312 whether to use the first coding mode (e.g., coding mode A) or the second coding mode (e.g., coding mode B) as follows. The electronic device 102 may determine an estimated number of peaks (e.g., "$P_{est}$") according to Equation (1).

$$P_{est} = \left\lceil \frac{\text{Frame Size}}{\text{Pitch Lag}} \right\rceil \quad (1)$$

In Equation (1), "Frame Size" is the size of the current transient frame 134 (in a number of samples or an amount of time, for example). "Pitch Lag" is the value of the estimated pitch lag 142 for the current transient frame 134 (in a number of samples or an amount of time, for example).

The electronic device 102 may select the first coding mode (e.g., coding mode A), if the number of peak locations 132 is greater than or equal to $P_{est}$. Additionally, the electronic device 102 may select the first coding mode (e.g., coding mode A) if a last peak in the set of peak locations 132 is within a (first) distance $d_1$ from the end of the current transient frame 134 and a first peak in the set of peak locations 132 is within a (second) distance $d_2$ from the start of the current transient frame 134. Both $d_1$ and $d_2$ may be determined based on the pitch lag 142. One example of $d_1$ and $d_2$ is the pitch lag 142 (e.g., $d_1$=$d_2$=pitch_lag). The second coding mode (e.g., coding mode B) may be selected if the energy ratio 182 between the previous frame 110 (which may be a transient frame 134 or other frame 136) and the current transient frame 134 of the speech signal 106 is outside a predetermined range. For example, the energy ratio 182 may be determined by calculating the energy of the speech/residuals of the previous frame and calculating the energy of the speech/residuals of the current frame and taking a ratio of these two energy values. For instance, the range may be 0.00001≤energy ratio≤100000. Additionally, the second coding mode (e.g., coding mode B) may be selected if the frame type 126 of the previous frame 110 (which may be a transient frame 134 or other frame 136) of the speech signal 106 was unvoiced or silent.

If the first coding mode (e.g., coding mode A) is selected, the electronic device 102 may synthesize 314 an excitation 150 based on the first coding mode (e.g., coding mode A) for the current transient frame 134. In other words, the electronic device 102 may synthesize 314 an excitation in response to the coding mode selected.

In one configuration, the electronic device 102 may synthesize 314 an excitation 150 based on the first coding mode (e.g., coding mode A) as follows. The electronic device 102 may determine the location of a last peak in the current transient frame 134 based on a last peak location in the previous frame 110 (which may be a transient frame 134 or other frame 136) and the pitch lag 142 of the current transient frame 134. The excitation 150 signal may be synthesized between the last sample of the previous frame 110 and the first sample location of the last peak in the current transient frame 134 using waveform interpolation. The waveform interpolation may use a prototype waveform 146 that is based on the pitch lag 142 and a predetermined spectral shape if the first coding mode (e.g., coding mode A) is selected.

If the second coding mode (e.g., coding mode B) is selected, the electronic device 102 may synthesize 316 an excitation 150 based on the second coding mode (e.g., coding mode B) for the current transient frame 134. In other words, the electronic device 102 may synthesize 316 an excitation 150 in response to the coding mode selected.

In one configuration, if the second coding mode (e.g., coding mode B) is selected, the electronic device 102 may synthesize 316 the excitation signal 150 by repeated placement of the prototype waveform 146 (which may be based on the pitch lag 142 and a predetermined spectral shape). The prototype waveform 146 may be repeatedly placed starting with a starting or first location (which may be determined based on the first peak location from the set of peak locations 132). The number of times that he prototype waveform 146 is repeatedly placed may be determined based on the pitch lag, the starting location and the current transient frame 134 size. It should be noted that the entire prototype waveform 146 may not fit an integer number of times in some cases. For example, if 5.5 prototypes are required to fill a frame, then the current frame may be constructed with 6 prototypes and the remainder or extra may be used in the next frame (if it is also a transient frame 134) or may discarded (if the frame is not transient (e.g., QPPP or unvoiced)).

The electronic device 102 may determine 318 a plurality (e.g., multitude) of scaling factors 154 (e.g., gains) based on the synthesized excitation 150 and the transient speech frame 134. The electronic device 102 may quantize 320 the plurality of scaling factors 154 to produce a plurality of quantized scaling factors.

The electronic device 102 may send 322 a coding mode 186, a pitch lag 142, the quantized LPC coefficients 116, the scaling factors 154 (or quantized scaling factors 158) and/or a frame type 126 to a decoder (on the same or different electronic device) and/or to a storage device.

Figure 4:
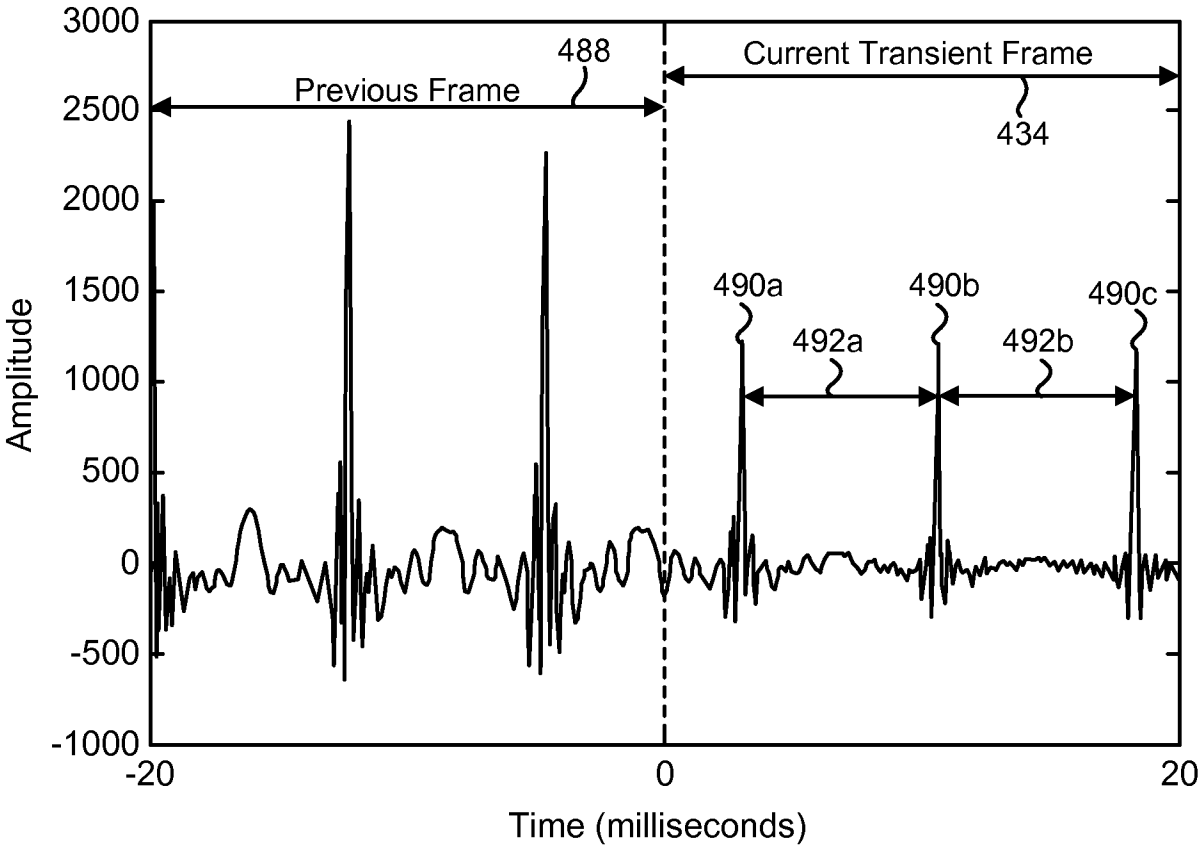
FIG. 4 is a graph illustrating an example of a previous frame and a current transient frame.

FIG. 4 is a graph illustrating an example of a previous frame 488 and a current transient frame 434. In the example illustrated in FIG. 4, the graph illustrates a previous frame 488 and a current transient frame 434 that may be used according to the systems and methods disclosed herein. For instance, the waveform illustrated within the current transient frame 434 may be an example of the residual signal 114 of a frame 110 that has been classified as a transient frame 134. The waveform illustrated within the previous frame 488 may be an example of a residual signal from a previous frame 110 (which could be a transient frame 134 or other frame 136, for example). In the example illustrated in FIG. 4, an electronic device 102 may use the systems and methods disclosed herein to determine to use a first coding mode (e.g., voiced coding mode or coding mode A). For instance, the electronic device 102 may use the method 200 described in connection with FIG. 2 in order to determine that the first coding mode (e.g., coding mode A) should be used in this example.

More specifically, FIG. 4 illustrates one example of a current transient frame 434 that may be termed a "voiced transient" frame. A first coding mode or coding mode A may be used when a "voiced transient" frame 434 is detected by the electronic device 102. As can be observed from the graph in FIG. 4, a voiced transient frame 434 may occur (and hence, the first coding mode or coding mode A may be used) when there is a periodicity and/or continuity with respect to the previous frame 488. For instance, if the electronic device 102 identifies three peaks 490*a-c* and takes the length of the current transient frame 434 divided by the pitch lag 492 (which is a distance between peaks), the quotient will likely be about three. It should be noted that one of the pitch lags 492*a-b* could be used in this calculation or an average pitch lag 492 could be used. As can be observed in FIG. 4, there is some continuity between the previous frame 488 and the current transient frame 434. This may mean, for example, that three peaks may be expected in the current transient frame 434 because the length of the current transient frame 434 divided by the pitch lag 492 is three or less and three peaks 490*a-c* may be detected in the current transient frame 434.

This may indicate that the current transient frame 434 is roughly continuous with respect to the previous frame 488.

The first coding mode (e.g., coding mode A) may be used when the current transient frame 434 is detected as being approximately continuous with respect to the previous frame 488. Thus, although the current transient frame 434 is transient, it may behave like an extension from the previous frame 488. A key piece of information may thus be how the peaks 490*a-c* are located. It should be noted that peaks may be very different, which may make a frame more transient. Another possibility is that the LPC may change somewhere throughout the frame, which may be why the frame is transient. As can be observed in the residual signal in FIG. 4, however, the current transient frame 434 may be synthesized by extending the past signal (from the previous frame 488, for example). The electronic device 102 may thus select the first coding mode (e.g., coding mode A) in order to code the current transient frame 434 accordingly.

It should be noted that the y or vertical axis in FIG. 4 plots the amplitude (e.g., signal amplitudes) of the waveform. The x or horizontal axis in FIG. 4 illustrates time (in milliseconds, for example). Depending on the configuration, the signal itself may be a voltage, current or a pressure variation, etc.

Figure 5:
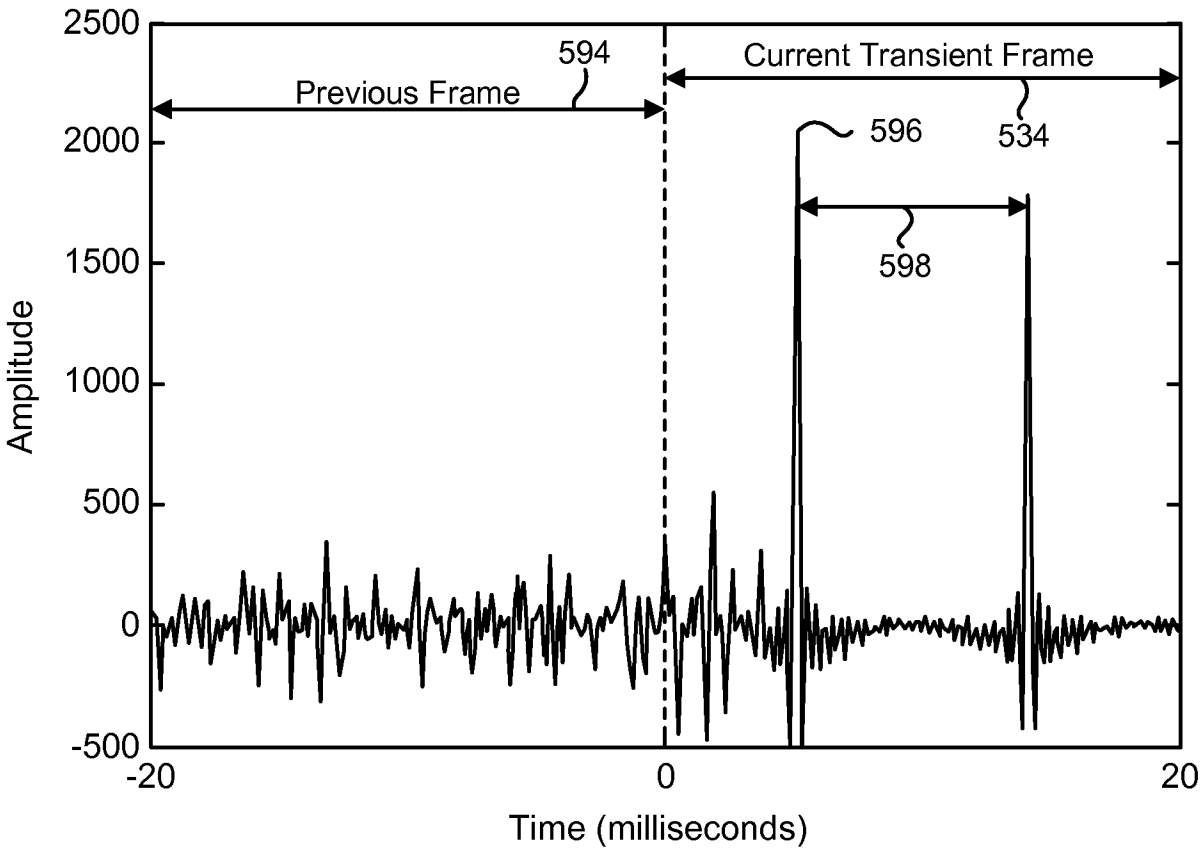
FIG. 5 is a graph illustrating another example of a previous frame and a current transient frame.

FIG. 5 is a graph illustrating another example of a previous frame 594 and a current transient frame 534. More specifically, the graph illustrates an example of a previous frame 594 and a current transient frame 534 that may be used according to the systems and methods disclosed herein. For instance, an electronic device 102 may detect or classify the current transient frame 534 as an "other transient" frame. When an "other transient" frame 534 is detected, the electronic device 102 may use a second coding mode (e.g., coding mode B). For instance, the electronic device 102 may use the method 200 described in connection with FIG. 2 in order to determine that the second coding mode (e.g., coding mode B) should be used in this example.

As can be observed in FIG. 5 (and in contrast to the example shown in FIG. 4), there may be little or no continuity between the previous frame 594 and the current transient frame 534. The electronic device 102 may use the second coding mode (e.g., coding mode B) when there is no continuity with respect to a previous frame 594. When the second coding mode (e.g., "other transient" coding mode or coding mode B) is used, an approximate start location in the current transient frame 534 may be determined. The electronic device 102 may then synthesize the current transient frame 534 by repeatedly placing prototype waveforms beginning at the start location until the end of the current transient frame 534 is reached. For instance, the electronic device 102 may determine the start location as the location of the first peak 596 in the current transient frame 534. Furthermore, the electronic device 102 may generate the prototype waveform 146 based on the detected pitch lag 598 and repeatedly place the prototype waveform 146 from the start location until the end of the current transient frame 534.

Figure 6:
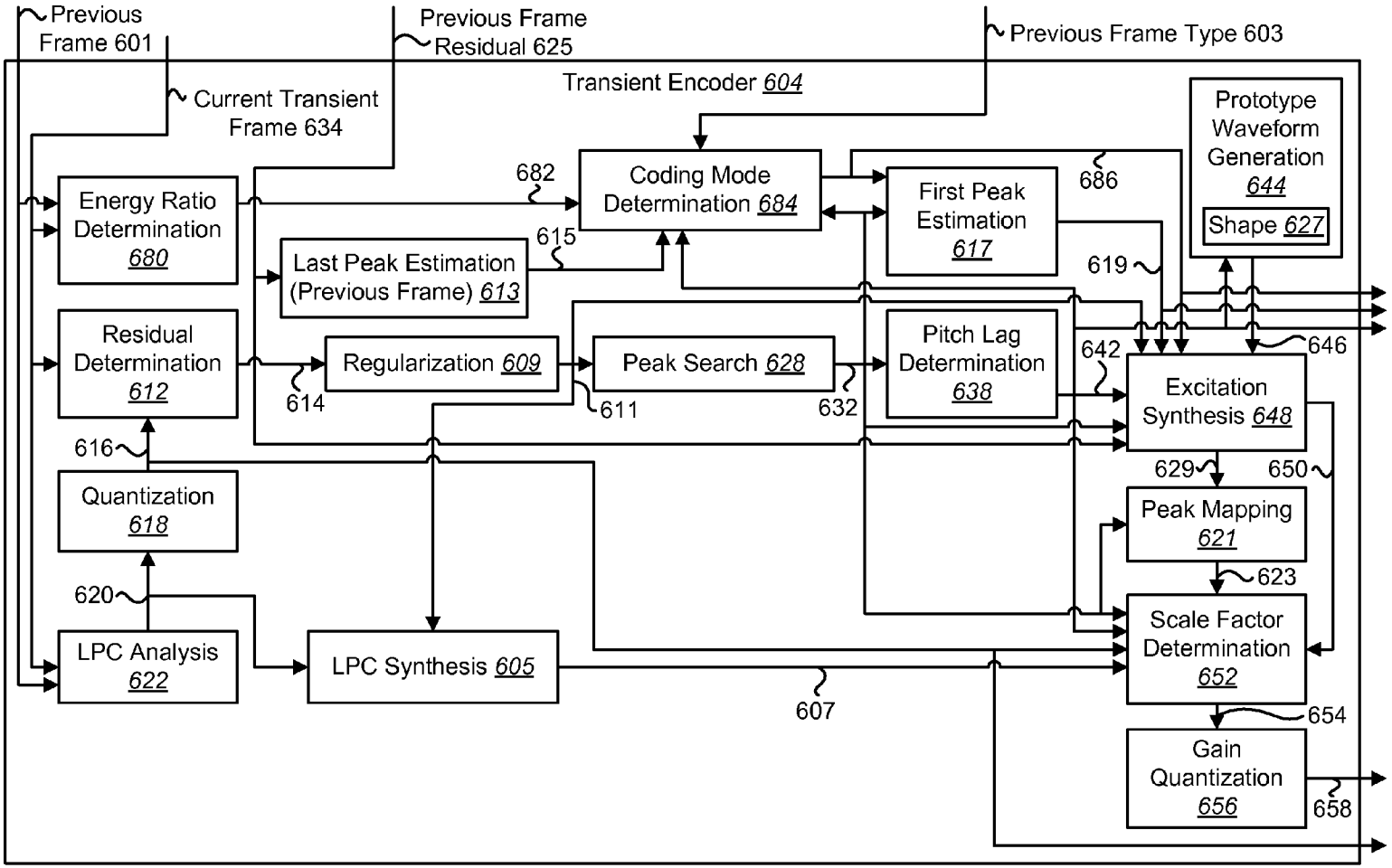
FIG. 6 is a block diagram illustrating one configuration of a transient encoder in which systems and methods for coding a transient frame may be implemented.

FIG. 6 is a block diagram illustrating one configuration of a transient encoder 604 in which systems and methods for coding a transient frame may be implemented. One example of the transient encoder 604 is a Linear Predictive Coding (LPC) encoder. The transient encoder 604 may be used by an electronic device 102 to encode a transient frame of a speech (or audio) signal 106. For instance, the transient encoder 604 encodes transient frames of a speech signal 106 into a "compressed" format by estimating or generating a set of parameters that may be used to synthesize (a transient frame of) the speech signal 106. In one configuration, such parameters may represent estimates of pitch (e.g., frequency), amplitude and formants (e.g., resonances).

The transient encoder 604 may obtain a current transient frame 634. For instance, the current transient frame 634 may include a particular number of speech signal samples and/or include an amount of time (e.g., 10-20 milliseconds) of the speech signal 106. A transient frame, for example, may be situated on the boundary between one speech class and another speech class. For example, a speech signal 106 may transition from an unvoiced sound (e.g., f, s, sh, th, etc.) to a voiced sound (e.g., a, e, i, o, u, etc.). Some transient types include up transients (when transitioning from an unvoiced to a voiced part of a speech signal 106, for example), plosives, voiced transients (e.g., Linear Predictive Coding (LPC) changes and pitch lag variations) and down transients (when transitioning from a voiced to an unvoiced or silent part of a speech signal 106 such as word endings, for example). One or more frames in-between the two speech classes may be one or more transient frames. A transient frame may be detected by analysis of the variations in pitch lag, energy, etc. If this phenomenon extends over multiple frames, then they may be marked as transients. Furthermore, transient frames may be further classified as "voiced transient" frames or "other transient" frames.

The transient encoder 604 may also obtain a previous frame 601 or one or more samples from a previous frame 601. In one configuration, the previous frame 601 may be provided to an energy ratio determination block/module 680 and/or an LPC analysis block/module 622. The transient encoder 604 may additionally obtain a previous frame type 603, which may be provided to a coding mode determination block/module 684. The previous frame type 603 may indicate the type of a previous frame, such as silent, unvoiced, voiced or transient.

The transient encoder 604 may use a linear predictive coding (LPC) analysis block/module 622 to perform a linear prediction analysis (e.g., LPC analysis) on a current transient frame 634. It should be noted that the LPC analysis block/module 622 may additionally or alternatively use a signal (e.g., one or more samples) from a previous frame 601. For example, in the case that the previous frame 601 is a transient frame, the LPC analysis block/module 622 may use one or more samples from the previous transient frame 601. Furthermore, if the previous frame 601 is another kind of frame (e.g., voiced, unvoiced, silent, etc.), the LPC analysis block/module 622 may use one or more samples from the previous other frame 601.

The LPC analysis block/module 622 may produce one or more LPC coefficients 620. The LPC coefficients 620 may be provided to a quantization block/module 618, which may produce one or more quantized LPC coefficients 616. The quantized LPC coefficients 616 and one or more samples from the current transient frame 634 may be provided to a residual determination block/module 612, which may be used to determine a residual signal 614. For example, a residual signal 614 may include a transient frame 634 of the speech signal 106 that has had the formants or the effects of the formants (e.g., coefficients) removed from the speech signal 106. The residual signal 614 may be provided to a regularization block/module 609.

The regularization block module 609 may regularize the residual signal 614, resulting in a modified (e.g., regularized) residual signal 611. For example, regularization moves pitch pulses in the current frame to line them up with a smoothly evolving pitch contour. In one configuration, the process of regularization may be used as described in detail in section 4.11.6 of 3GPP2 document C.S0014D titled "Enhanced Variable Rate Codec, Speech Service Options 3, 68, 70, and 73 for Wideband Spread Spectrum Digital Systems." The modified residual signal 611 may be provided to a peak search block/module 628, to an LPC synthesis block/module 605 and/or an excitation synthesis block/module 648. The LPC synthesis block/module 605 may produce (e.g., synthesize) a modified speech signal 607, which may be provided to the scale factor determination block/module 652.

The peak search block/module 628 may search for peaks in the modified residual signal 611. In other words, the transient encoder 604 may search for peaks (e.g., regions of high energy) in the modified residual signal 611. These peaks may be identified to obtain a list or set of peaks 632 that includes one or more peak locations. Peak locations in the list or set of peaks 632 may be specified in terms of sample number and/or time, for example.

The set of peaks 632 may be provided to the coding mode determination block/module 684, the pitch lag determination block/module 638 and/or the scale factor determination block/module 652. The pitch lag determination block/module 638 may use the set of peaks 632 to determine a pitch lag 642. A "pitch lag" may be a "distance" between two successive pitch spikes in a current transient frame 634. A pitch lag 642 may be specified in a number of samples and/or an amount of time, for example. In some configurations, the pitch lag determination block/module 638 may use the set of peaks 632 or a set of pitch lag candidates (which may be the distances between the peaks 632) to determine the pitch lag 642. For example, the pitch lag determination block/module 638 may use an averaging or smoothing algorithm to determine the pitch lag 642 from a set of candidates. Other approaches may be used. The pitch lag 642 determined by the pitch lag determination block/module 638 may be provided to the coding mode determination block/module 684, an excitation synthesis block/module 648 and/or a scale factor determination block/module 652.

The coding mode determination block/module 684 may determine a coding mode 686 for a current transient frame 634. In one configuration, the coding mode determination block/module 684 may determine whether to use a voiced transient coding mode (e.g., a first coding mode) for the current transient frame 634 or an "other transient" coding mode (e.g., a second coding mode) for the current transient frame 634. For instance, the coding mode determination block/module 684 may determine whether the transient frame is a voiced transient frame or other transient frame. A voiced transient frame may be transient frame that has some continuity from the previous frame 601 (one example is described above in connection with FIG. 4). An "other transient" frame may be a transient frame that has little or no continuity from the previous frame 601 (one example is described above in connection with FIG. 5). The coding mode determination block/module 684 may use one or more kinds of information to make this determination. For example, the coding mode determination block/module 684 may use a set of peaks 632, a pitch lag 642, an energy ratio 682 and/or a previous frame type 603 to make this determination. One example of how the coding mode determination block/module 684 may determine the coding mode 686 is given in connection with FIG. 7 below.

The energy ratio 682 may be determined by an energy ratio determination block/module 680 based on an energy ratio between a previous frame 601 and a current transient frame 634. The previous frame 601 may be a transient frame or another kind of frame (e.g., silence, voiced, unvoiced, etc.).

The coding mode determination block/module 684 may generate a coding mode 686 that indicates a selected coding mode for the current transient frame 634. For example, the coding mode 686 may indicate a voiced transient coding mode if the current transient frame 634 is a "voiced transient" frame or may indicate an "other transient" coding mode if the current transient frame 634 is an "other transient" frame. In one configuration, the coding mode determination block/module 684 may make this determination based on a last peak 615 from a previous frame residual 625. For example, the last peak estimation block/module 613 that feeds into the coding mode determination block/module 684 may estimate the last peak 615 of the previous frame based on the previous frame residual 625. This may allow the transient encoder 604 to search for continuity into the current or present frame, starting with the last peak 615 of the previous frame. The coding mode 686 may be sent (e.g., provided) to the excitation synthesis block/module 648, to storage, to a "local" decoder and/or to a remote decoder (on another device). For example, the coding mode 686 may be provided to a TX/RX block/module, which may format and send the coding mode 686 to another electronic device, where it may be provided to a decoder.

The excitation synthesis block/module 648 may generate or synthesize an excitation 650 based on a prototype waveform 646, the coding mode 686, (optionally) a first peak location 619 of the current frame, (optionally) the modified residual signal 611, the pitch lag 642, (optionally) an estimated last peak location from the current frame (from the set of peak of locations 632, for example) and/or a previous frame residual signal 625. For example, a first peak estimation block/module 617 may determine a first peak location 619 if an "other transient" coding mode 686 is selected. In that case, the first peak location 619 may be provided to the excitation synthesis block/module 648. In another example, the (transient) excitation synthesis block/module 648 may use a last peak location or value from the current transient frame 634 (from the list of peak locations 632 and/or determined based on the last peak of a previous frame 615 (which connection is not illustrated in FIG. 6 for convenience)) and a pitch lag 642, for example). The prototype waveform 646 may be provided by a prototype waveform generation block/module 644, which may generate the prototype waveform 646 based on a predetermined shape 627 and the pitch lag 642. Examples of how the excitation synthesis block/module 648 may synthesize the excitation 650 are given in connection with FIG. 8 below.

The excitation synthesis block/module 648 may provide a set of one or more synthesized excitation peak locations 629 to the peak mapping block/module 621. The set of peaks 632 (which are the set of peaks 632 from the modified residual signal 611 and should not be confused with the synthesized excitation peak locations 629) may also be provided to the peak mapping block/module 621. The peak mapping block/module 621 may generate a mapping 623 based on the set of peaks 632 and the synthesized excitation peak locations 629. The mapping 623 may be provided to the scale factor determination block/module 652.

The excitation 650, the mapping 623, the set of peaks 632, the pitch lag 642, the quantized LPC coefficients 616 and/or the modified speech signal 607 may be provided to a scale factor determination block/module 652, which may produce a set of gains 654 based on one or more of its inputs 650, 623, 632, 642, 616, 607. The set of gains 654 may be provided to a gain quantization block/module 656 that quantizes the set of gains 654 to produce a set of quantized gains 658.

The transient encoder 604 may send, output or provide one or more of the coding mode 686, (optionally) the first peak location 619, the pitch lag 642, the quantized gains 658 and the quantized LPC coefficients 616 to one or more blocks/modules or devices. For example, some or all of the information described 686, 619, 642, 658, 616 may be provided to a transmitter, which may format and/or transmit it to another device. Additionally or alternatively, some or all of the information 686, 619, 642, 658, 616 may be stored in memory and/or provided to a decoder. Some or all of the information 686, 619, 642, 658, 616 may be used to synthesize (e.g., decode) a speech signal locally or remotely. The decoded speech signal may then be output using a speaker, for example.

Figure 7:
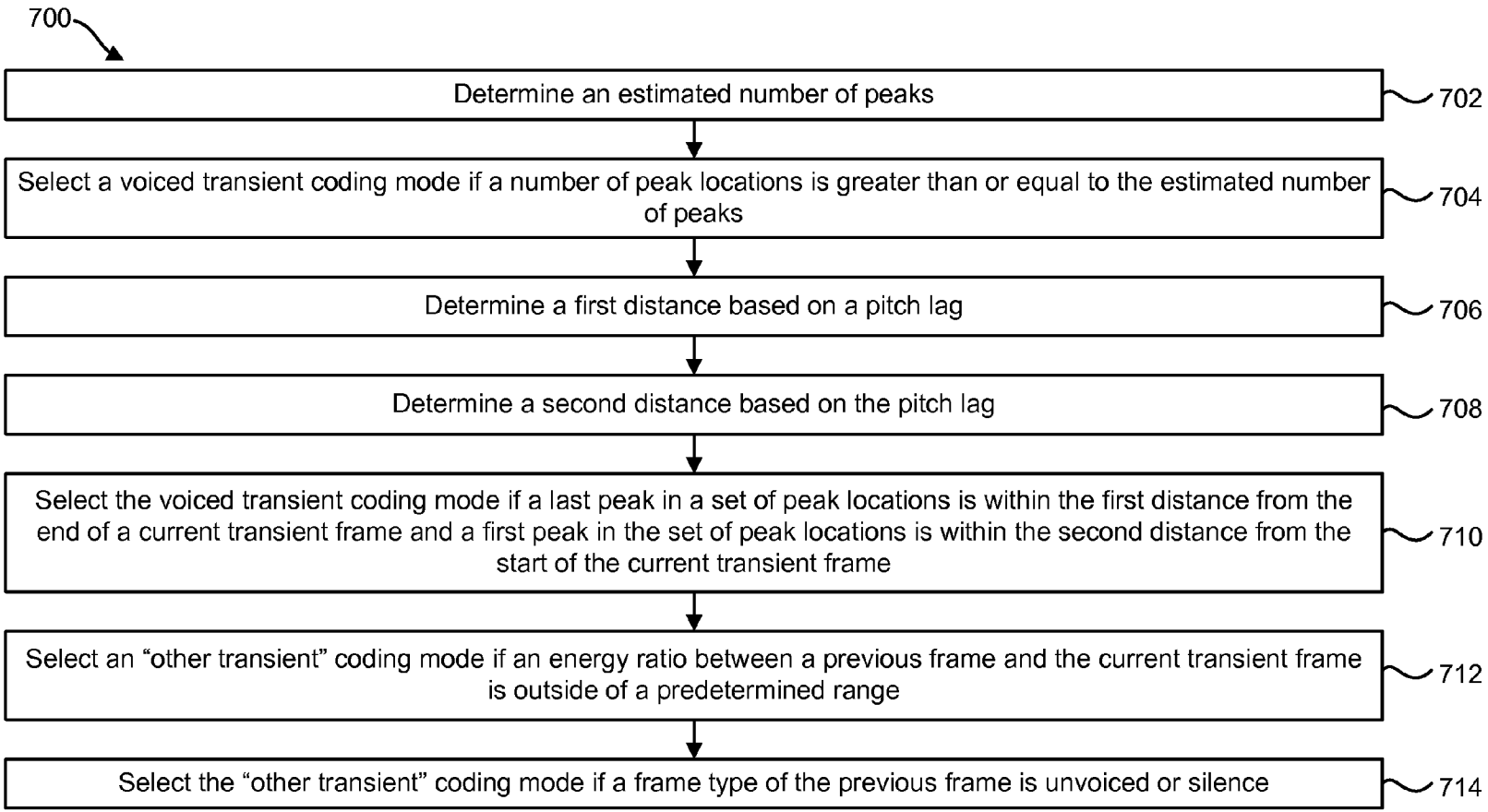
FIG. 7 is a flow diagram illustrating one configuration of a method for selecting a coding mode.

FIG. 7 is a flow diagram illustrating one configuration of a method 700 for selecting a coding mode. In this configuration, an electronic device (that includes a transient encoder 604, for example) may determine whether to use a "voiced transient" coding mode (e.g., first coding mode or coding mode A) or an "other transient" coding mode (e.g., second coding mode or coding mode B) as follows. The electronic device may determine 702 an estimated number of peaks (e.g., "$P_{est}$") according to Equation (2).

$$P_{est} = \left[\frac{\text{Frame Size}}{\text{Pitch Lag}}\right] \tag{2}$$

In Equation (2), "Frame Size" is the size of the current transient frame 634 (in a number of samples or an amount of time, for example). "Pitch Lag" is the value of the estimated pitch lag 642 for the current transient frame 634 (in a number of samples or an amount of time, for example). The electronic device may select 704 the voiced transient coding mode (e.g., first coding mode or coding mode A), if the number of peak locations 632 is greater than or equal to $P_{est}$.

The electronic device may determine 706 a first distance (e.g., $d_1$) based on a pitch lag 642. The electronic device may determine 708 a second distance (e.g., $d_2$) based on the pitch lag 642. In one configuration, $d_1$ and $d_2$ are set to be fixed fractions of the pitch lag 642. For example, $d_1$=0.2*pitch_lag and $d_2$=0.25*pitch_lag.

The electronic device may select 710 the voiced transient coding mode if a last peak in the set of peak locations 632 is within a first distance ($d_1$) from the end of the current transient frame 634 and a first peak in the set of peak locations 632 is within a second distance ($d_2$) from the start of the current transient frame 634. It should be noted that a distance may be measured in samples, time, etc.

The electronic device may select 712 an "other transient" coding mode (e.g., second coding mode or coding mode B) if an energy ratio 682 between a previous frame 601 and the current transient frame 634 (of the speech signal 106, for example) is outside a predetermined range. For example, the energy ratio 682 may be determined by calculating the energy of the speech/residuals of the previous frame and calculating the energy of the speech/residuals of the current frame and taking a ratio of these two energy values. One example of the predetermined range is 0.00001≤energy ratio≤100000. The electronic device may select 714 the "other transient" coding mode (e.g., coding mode B) if a previous frame type 603 is unvoiced or silence.

Figure 8:
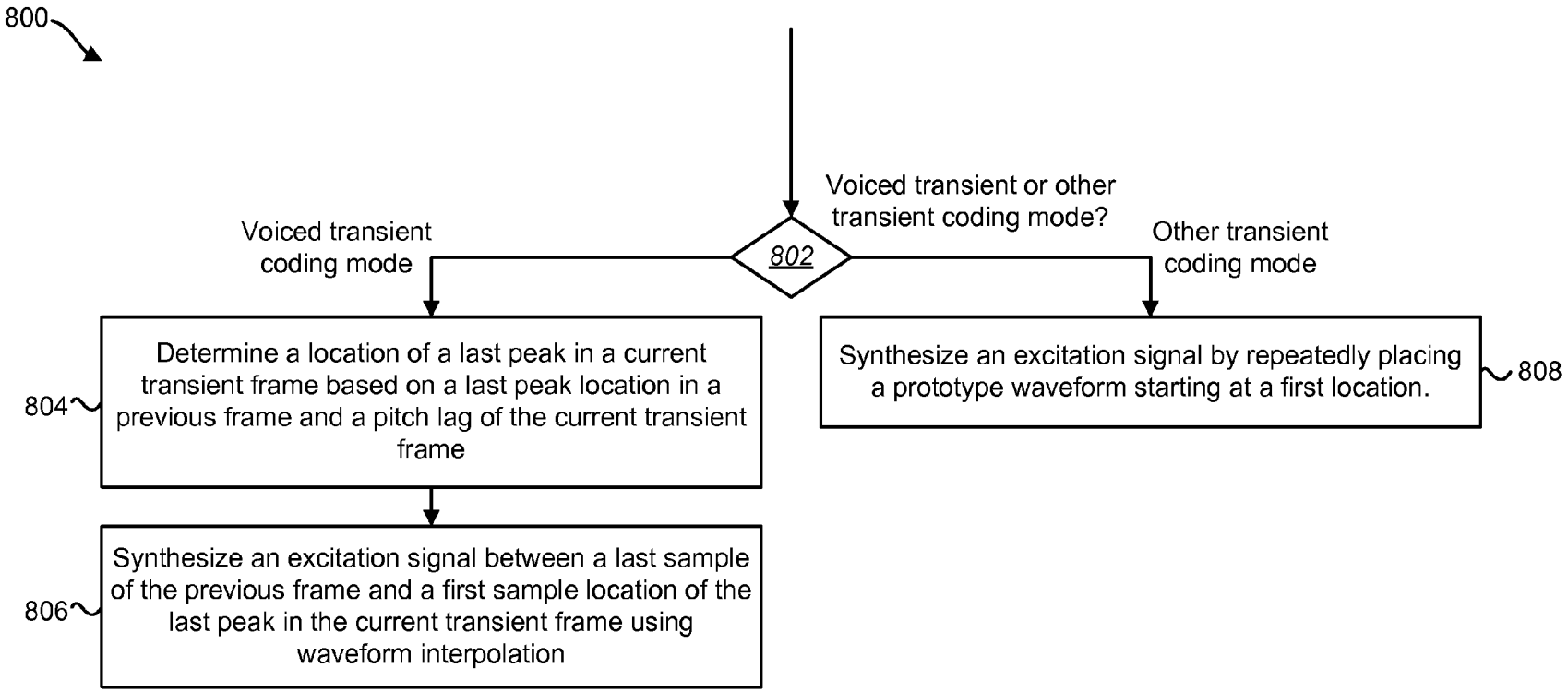
FIG. 8 is a flow diagram illustrating one configuration of a method for synthesizing an excitation signal.

FIG. 8 is a flow diagram illustrating one configuration of a method 800 for synthesizing an excitation signal. An electronic device 602 may determine 802 whether to use a voiced transient coding mode (e.g., first coding mode or coding mode A) or an "other transient" coding mode (e.g., second coding mode or coding mode B). For example, the electronic device 602 may make this determination using the method 700 described in connection with FIG. 7.

If the electronic device 602 determines 802 to use the voiced transient coding mode (in order to synthesize an excitation 650), then the electronic device 602 may determine 804 (e.g., estimate) a last peak location in a current transient frame 634. This determination 804 may be made based on a last peak location from a previous frame (e.g., a last peak 615 from the last peak estimation block/module 613 or a last peak from a set of peak locations 632 from a previous frame) and a pitch lag 642 from the current transient frame 634. For example, a previous frame residual signal 625 and a pitch lag 642 may be used to estimate the last peak location for the current transient frame 634. For instance, if the previous frame was transient, then the location of the last peak in the previous frame is known (e.g., from a previous frame's set of peak locations 632 or the last peak 615 from the last peak estimation block/module 613) and the location of the last peak in the present frame may be determined by moving a fixed number of pitch lag 642 values forward into the current frame until determining the last pitch cycle. If the previous frame is voiced, then a peak search may be performed (by the last peak estimation block/module 613 or by the excitation synthesis block/module 648, for example) to determine the location of the last peak in the previous frame. The voiced transient may never follow an unvoiced frame.

The electronic device 602 may synthesize 806 an excitation signal 650. The excitation signal 650 may be synthesized 806 between the last sample of the previous frame 601 and the first sample location of the (estimated) last peak location in the current transient frame 634 using waveform interpolation. The waveform interpolation may use a prototype waveform 646 that is based on the pitch lag 642 and a predetermined spectral shape 627.

If the electronic device 602 determines 802 to use the other transient coding mode (e.g., second coding mode or coding mode B), the electronic device 602 may synthesize 808 an excitation 650 using the other transient coding mode. For example, the electronic device 602 may synthesize 808 the excitation signal 650 by repeatedly placing a prototype waveform 646. The prototype waveform 646 may be generated or determined based on the pitch lag 642 and a predetermined spectral shape 627. The prototype waveform 646 may be repeatedly placed starting at a first location in the current transient frame 634. The first location may be determined based on the first peak location 619 from the set of peak locations 632. The number of times that the prototype waveform 646 is repeatedly placed may be determined based on the pitch lag 642, the first location and the current transient frame 634 size. For example, the prototype waveform 646 (and/or portions of the prototype waveform 646) may be repeatedly placed until the end of the current transient frame 634 is reached.

Figure 9:
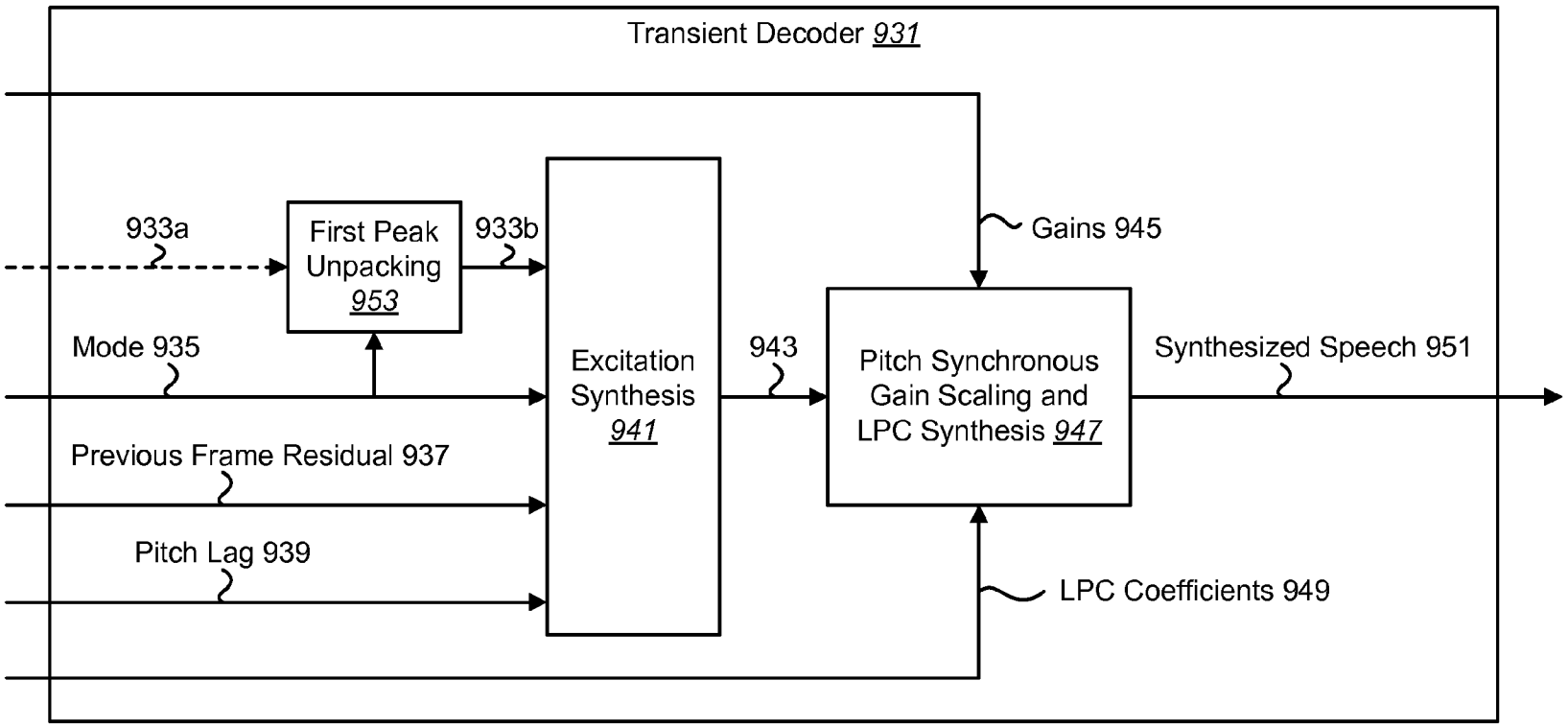
FIG. 9 is a block diagram illustrating one configuration of a transient decoder in which systems and methods for decoding a transient frame may be implemented.

FIG. 9 is a block diagram illustrating one configuration of a transient decoder 931 in which systems and methods for decoding a transient frame may be implemented. The decoder 931 may include an optional first peak unpacking block/module 953, an excitation synthesis block/module 941 and/or a pitch synchronous gain scaling and LPC synthesis block/module 947. One example of the transient decoder 931 is an LPC decoder. For instance, the transient decoder 931 may be a decoder 162, 174 as illustrated in FIG. 1 and/or may be one of the decoders included with a decoder 162, 174 as illustrated in FIG. 1.

The transient decoder 931 may obtain one or more of gains 945, a first peak location 933*a* (parameter), a mode 935, a previous frame residual 937, a pitch lag 939 and LPC coefficients 949. For example, a transient encoder 104 may provide the gains 945, the first peak location 933*a*, the mode 935, the pitch lag 939 and/or LPC coefficients 949. It should be noted that the previous frame residual may be a previous frame's decoded residual that the decoder stores after decoding the frame (at time n−1, for example). In one configuration, this information 945, 933*a*, 935, 939, 949 may originate from an encoder 104 that is on the same electronic device as the decoder 931. For instance, the transient decoder 931 may receive the information 945, 933*a*, 935, 939, 949 directly from an encoder 104 or may retrieve it from memory. In another configuration, the information 945, 933*a*, 935, 939, 949 may originate from an encoder 104 that is on a different electronic device 102 from the decoder 931. For instance, the transient decoder 931 may obtain the information 945, 933*a*, 935, 939, 949 from a receiver 170 that has received it from another electronic device 102. It should be noted that the first peak location 933*a* may not always be provided by an encoder 104, such as when a first coding mode (e.g., voiced transient coding mode) is used.

In some configurations, the gains 945, the first peak location 933*a*, the mode 935, the pitch lag 939 and/or LPC coefficients 949 may be received as parameters. More specifically, the transient decoder 931 may receive a gains parameter 945, a first peak location parameter 933*a*, a mode parameter 935, a pitch lag parameter 939 and/or an LPC coefficients parameter 949. For instance, each type of this information 945, 933*a*, 935, 939, 949 may be represented using a number of bits. In one configuration, these bits may be received in a packet. The bits may be unpacked, interpreted, de-formatted and/or decoded by an electronic device and/or the transient decoder 931 such that the transient decoder 931 may use the information 945, 933*a*, 935, 939, 949. In one configuration, bits may be allocated for the information 945, 933*a*, 935, 939, 949 as set forth in Table (1).

TABLE (1)

| Parameter | Number of Bits for Voiced Transients | Number of Bits for Other Transients |
|---|---|---|
| LPC Coefficients 949 (e.g., LSPs or LSFs) | 18 | 18 |
| Transient Coding Mode 935 | 1 | 1 |
| First Peak Location (in frame) 933a | — | 3 |
| Pitch Lag 939 | 7 | 7 |
| Frame Type | 2 | 2 |
| Gain 945 | 8 | 8 |
| Frame Error Protection | 2 | 1 |
| Total | 38 | 40 |

It should be noted that the frame type parameter illustrated in Table (1) may be used to select a decoder (e.g., NELP decoder, QPPP decoder, silence decoder, transient decoder, etc.) and frame error protection may be used to protect against (e.g., detect) frame errors.

The mode 935 may indicate whether a first coding mode (e.g., coding mode A or a voiced transient coding mode) or a second coding mode (e.g., coding mode B or an "other transient" coding mode) was used to encode a speech or audio signal. The mode 935 may be provided to the first peak unpacking block/module 953 and/or to the excitation synthesis block/module 941.

If the mode 935 indicates a second coding mode (e.g., other transient coding mode), then the first peak unpacking block/module 953 may retrieve or unpack a first peak location 933*b*. For example, the first peak location 933*a* received by the transient decoder 931 may be a first peak location parameter 933*a* that represents the first peak location using a number of bits (e.g., three bits). Additionally or alternatively, the first peak location 933*a* may be included in a packet with other information (e.g., header information, other payload information, etc.). The first peak unpacking block/module 953 may unpack the first peak location parameter 933*a* and/or interpret (e.g., decode, de-format, etc.) the peak location parameter 933*a* to obtain a first peak location 933*b*. In some configurations, however, the first peak location 933*a* may be provided to the transient decoder 931 in a format such that unpacking is not needed. In that configuration, the transient decoder 931 may not include a first peak unpacking block/module 953 and the first peak location 933 may be provided directly to the excitation synthesis block/module 941.

In cases where the mode 935 indicates a first coding mode (e.g., voiced transient coding mode), the first peak location (parameter) 933*a* may not be received and/or the first peak unpacking block/module 953 may not need to perform any operation. In such a case, a first peak location 933 may not be provided to the excitation synthesis block/module 941.

The excitation synthesis block/module 941 may synthesize an excitation 943 based on a pitch lag 939, a previous frame residual 937, a mode 935 and/or a first peak location 933. The first peak location 933 may only be used to synthesize the excitation 943 if the second coding mode (e.g., other transient coding mode) is used, for example. One example of how the excitation 943 may be synthesized is given in connection with FIG. 11 below.

The excitation 943 may be provided to the pitch synchronous gain scaling and LPC synthesis block/module 947. The pitch synchronous gain scaling and LPC synthesis block/module 947 may use the excitation 943, the gains 945 and the LPC coefficients 949 to produce a synthesized or decoded speech signal 951. One example of a pitch synchronous gain scaling and LPC synthesis block/module 947 is described in connection with FIG. 14 below. The synthesized speech signal 951 may be stored in memory, be output using a speaker and/or be transmitted to another electronic device.

Figure 10:
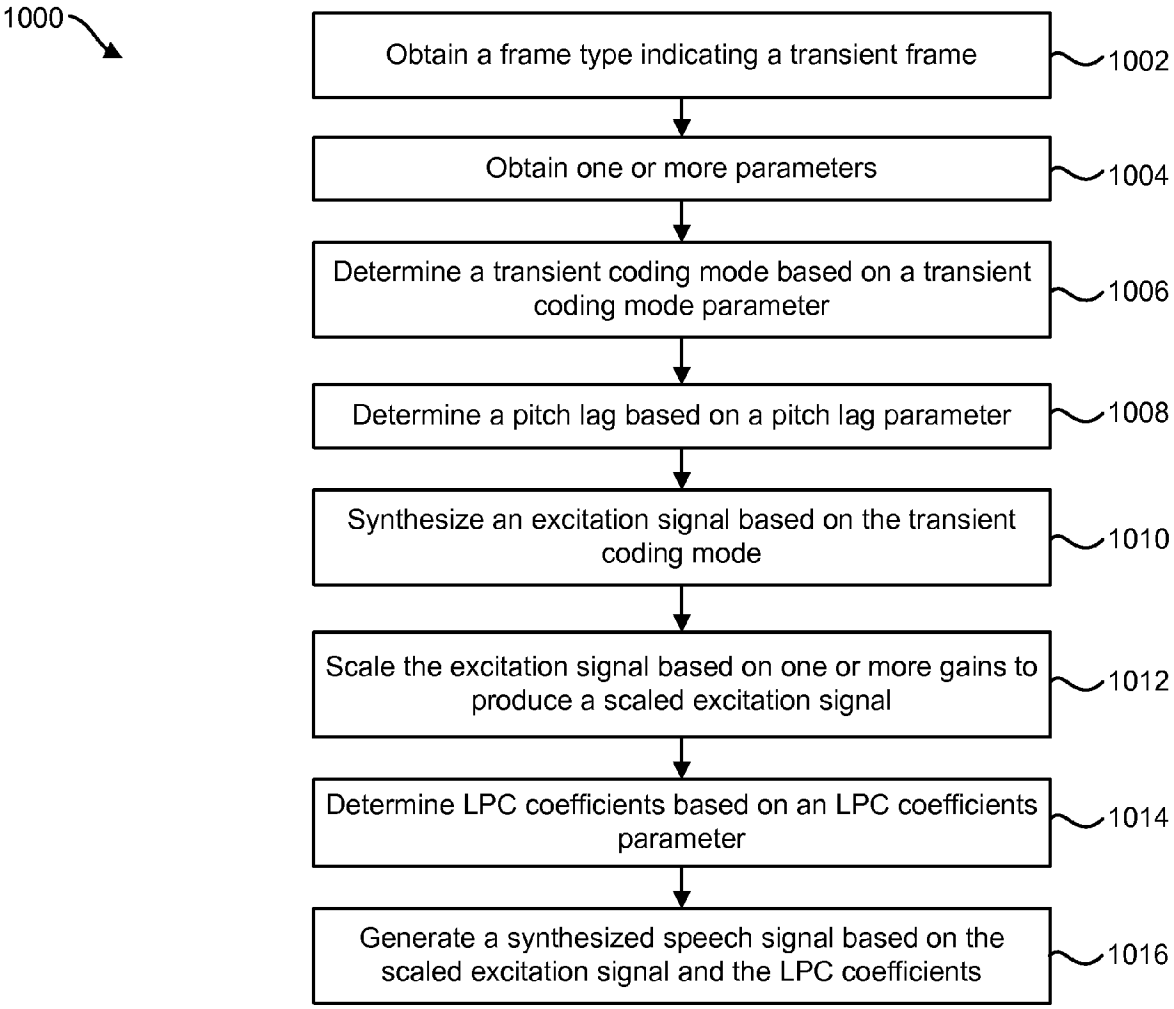
FIG. 10 is a flow diagram illustrating one configuration of a method for decoding a transient frame.

FIG. 10 is a flow diagram illustrating one configuration of a method 1000 for decoding a transient frame. An electronic device may obtain (e.g., receive, retrieve, etc.) 1002 a frame type (e.g., indicator or parameter, such as a frame type 126 illustrated in FIG. 1) indicating a transient frame. In other words, the electronic device may perform the method 1000 illustrated in FIG. 10 when the frame type indicates that the frame type of a current frame is a transient frame. In some configurations, the frame type may be a frame type parameter that was sent from an encoding electronic device.

An electronic device may obtain 1004 one or more parameters. For example, the electronic device may receive, retrieve or otherwise obtain parameters representing gains 945, a first peak location 933*a*, a (transient coding) mode 935, a pitch lag 939 and/or LPC coefficients 949. For instance, the electronic device may receive one or more of these parameters from another electronic device (as one or more packets or messages), may retrieve one or more of the parameters from memory and/or may otherwise obtain one or more of the parameters from an encoder 104. In one configuration, the parameters may be received wirelessly and/or from a satellite.

The electronic device may determine 1006 a transient coding mode 935 based on a transient coding mode parameter. For instance, the electronic device may unpack, decode and/ or de-format the transient coding mode parameter in order to obtain a transient coding mode 935 that is usable by a transient decoder 931. The transient coding mode 935 may indicate a first coding mode (e.g., coding mode A or voiced transient coding mode) or it 935 may indicate a second coding mode (e.g., coding mode B or other transient coding mode).

The electronic device may also determine 1008 a pitch lag 939 based on a pitch lag parameter. For instance, the electronic device may unpack, decode and/or de-format the pitch lag parameter in order to obtain a pitch lag 939 that is usable by a transient decoder 931.

The electronic device may synthesize 1010 an excitation signal 943 based on the transient coding mode 935. For example, if the transient coding mode 935 indicates a second coding mode (e.g., other transient coding mode), then the electronic device may synthesize 1010 the excitation signal 943 using a first peak location 933. Otherwise, the electronic device may synthesize 1010 the excitation signal 943 without using the first peak location 933. A more detailed example of synthesizing 1010 the excitation signal 943 based on the transient coding mode 935 is given in connection with FIG. 11 below.

The electronic device may scale 1012 the excitation signal 943 based on one or more gains 945 to produce a scaled excitation signal 943. For example, the electronic device may apply the gains (e.g., scaling factors) 945 to the excitation signal by multiplying the excitation signal 943 with one or more scaling factors or gains 945.

The electronic device may determine 1014 LPC coefficients 949 based on an LPC parameter. For instance, the electronic device may unpack, decode and/or de-format the LPC coefficients parameter 949 in order to obtain LPC coefficients 949 that are usable by a transient decoder 931.

The electronic device may generate 1016 a synthesized speech signal 951 based on the scaled excitation signal 943 and the LPC coefficients 949. One example of generating 1016 a synthesized speech signal 951 is described below in connection with FIG. 14. The synthesized speech signal 951 may be stored in memory, be output using a speaker and/or be transmitted to another electronic device.

Figure 11:
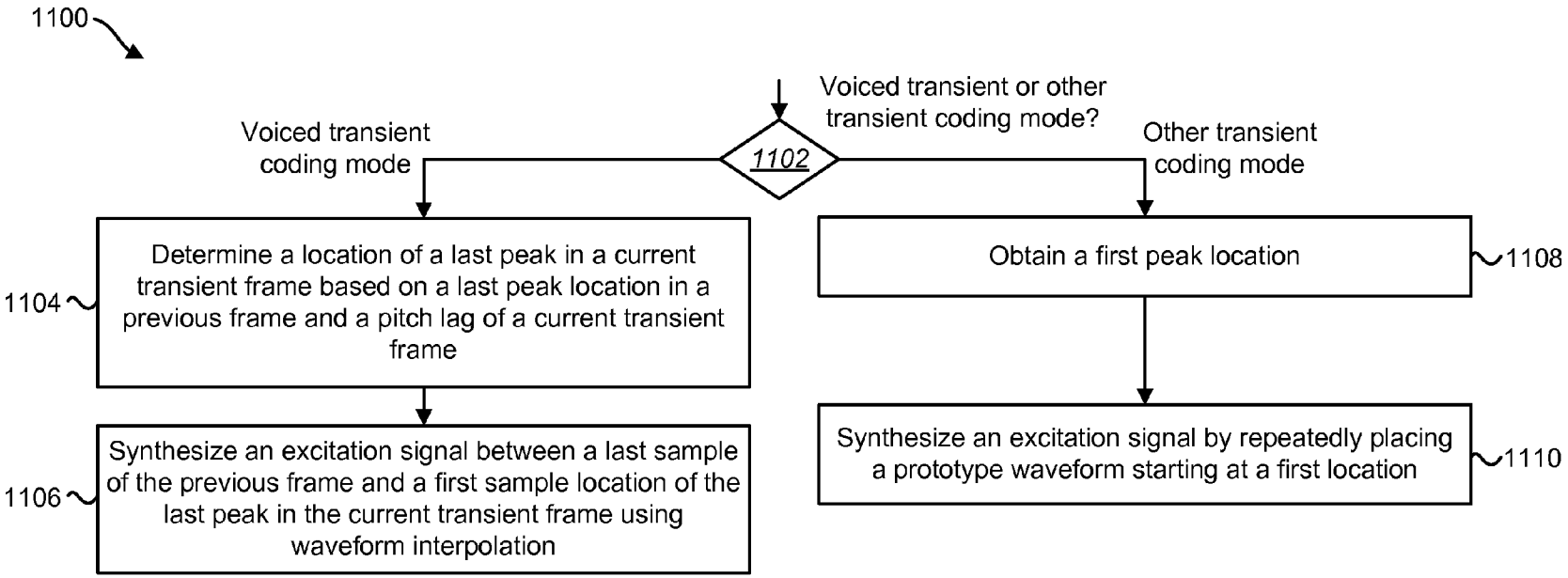
FIG. 11 is a flow diagram illustrating one configuration of a method for synthesizing an excitation signal.

FIG. 11 is a flow diagram illustrating one configuration of a method 1100 for synthesizing an excitation signal. The method 1100 illustrated in FIG. 11 may be used by a transient decoder 931 in order to generate a synthesized speech signal 951, for example. An electronic device may determine 1102 whether a voiced transient coding mode (e.g., first coding mode or coding mode A) or an "other transient" coding mode (e.g., second coding mode or coding mode B) is used. In one configuration, the electronic device obtains or receives a coding mode parameter that indicates whether the voiced transient coding mode or other transient coding mode is used. For instance, the coding mode parameter may be a single bit, where a '1' indicates a voiced transient coding mode and a '0' indicates an "other transient" coding mode or vice versa.

If the electronic device determines 1102 that the voiced transient coding mode is used, then the electronic device may determine 1104 (e.g., estimate) a last peak location in a current transient frame. This determination 1104 may be made based on a last peak location from a previous frame and a pitch lag 939 from the current transient frame. For example, the electronic device may use a previous frame residual signal 937 and a pitch lag 939 to estimate the last peak location.

The electronic device may synthesize 1106 an excitation signal 943. The excitation signal 943 may be synthesized 1106 between the last sample of the previous frame and the first sample location of the (estimated) last peak location in the current transient frame using waveform interpolation. The waveform interpolation may use a prototype waveform that is based on the pitch lag 939 and a predetermined spectral shape.

If the electronic device determines 1102 to use the other transient coding mode (e.g., second coding mode or coding mode B), the electronic device may obtain 1108 a first peak location 933. In one example, the electronic device may unpack a received first peak location parameter and/or interpret (e.g., decode, de-format, etc.) the peak location parameter to obtain a first peak location 933. In another example, the electronic device may retrieve the first peak location 933 from memory or may obtain 1108 the first peak location 933 from an encoder.

The electronic device may synthesize 1110 an excitation 943 using the other transient coding mode. For example, the electronic device may synthesize 1110 the excitation signal 943 by repeatedly placing a prototype waveform. The prototype waveform may be generated or determined based on the pitch lag 939 and a predetermined spectral shape. The prototype waveform may be repeatedly placed starting at a first location. The first location may be determined based on the first peak location 933. The number of times that the prototype waveform is repeatedly placed may be determined based on the pitch lag 939, the first location and the current transient frame size. For example, the prototype waveform may be repeatedly placed until the end of the current transient frame is reached. It should be noted that a portion of the prototype waveform may also be placed (in the case where an integer number of full prototype waveforms do not even fit within the frame) and/or a leftover portion may be placed in a following frame or discarded.

Figure 12:
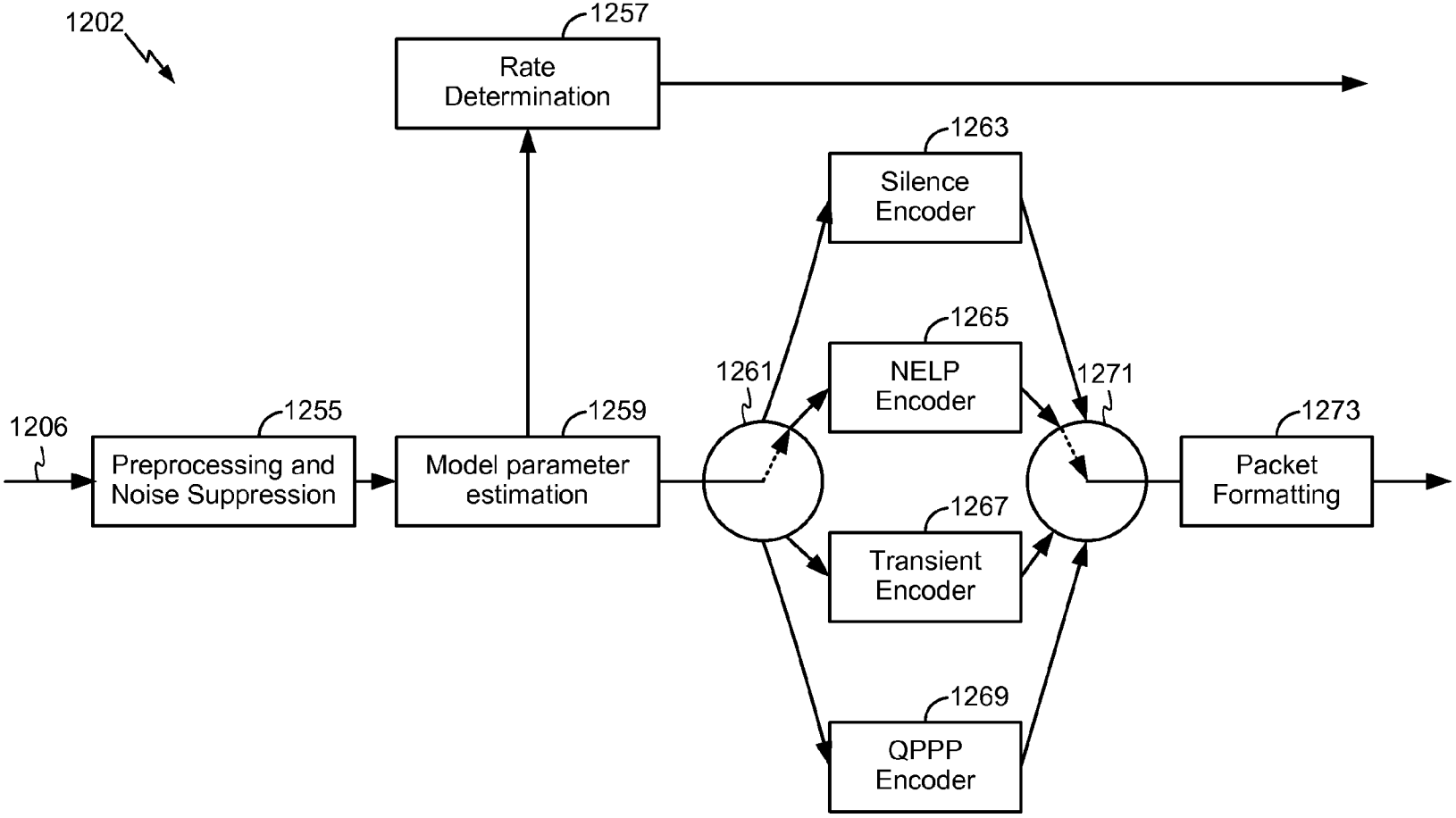
FIG. 12 is a block diagram illustrating one example of an electronic device in which systems and methods for encoding a transient frame may be implemented.

FIG. 12 is a block diagram illustrating one example of an electronic device 1202 in which systems and methods for encoding a transient frame may be implemented. In this example, the electronic device 1202 includes a preprocessing and noise suppression block/module 1255, a model parameter estimation block/module 1259, a rate determination block/module 1257, a first switching block/module 1261, a silence encoder 1263, a noise excited linear prediction (NELP) encoder 1265, a transient encoder 1267, a quarter-rate prototype pitch period (QPPP) encoder 1269, a second switching block/module 1271 and a packet formatting block/module 1273.

The preprocessing and noise suppression block/module 1255 may obtain or receive a speech signal 1206. In one configuration, the preprocessing and noise suppression block/module 1255 may suppress noise in the speech signal 1206 and/or perform other processing on the speech signal 1206, such as filtering. The resulting output signal is provided to a model parameter estimation block/module 1259.

The model parameter estimation block/module 1259 may estimate LPC, a first cut pitch lag and normalized autocorrelation at the first cut pitch lag. For example, this procedure may be similar to that used in the enhanced variable rate codec/enhanced variable rate codec B and/or enhanced variable rate codec wideband (EVRC/EVRC-B/EVRC-WB). The rate determination block/module 1257 may determine a coding rate for encoding the speech signal 1206. The coding rate may be provided to a decoder for use in decoding the (encoded) speech signal 1206.

The electronic device 1202 may determine which encoder to use for encoding the speech signal 1206. It should be noted that, at times, the speech signal 1206 may not always contain actual speech, but may contain silence and/or noise, for example. In one configuration, the electronic device 1202 may determine which encoder to use based on the model parameter estimation 1259. For example, if the electronic device 1202 detects silence in the speech signal 1206, it 1202 may use the first switching block/module 1261 to channel the (silent) speech signal through the silence encoder 1263. The first switching block/module 1261 may be similarly used to switch the speech signal 1206 for encoding by the NELP encoder 1265, the transient encoder 1267 or the QPPP encoder 1269, based on the model parameter estimation 1259.

The silence encoder 1263 may encode or represent the silence with one or more pieces of information. For instance, the silence encoder 1263 could produce a parameter that represents the length of silence in the speech signal 1206. Two examples of coding silence/background that may be used for some configurations of the systems and methods disclosed herein are described in sections 4.15 and 4.17 of 3GPP2 document C.S0014D titled "Enhanced Variable Rate Codec, Speech Service Options 3, 68, 70, and 73 for Wideband Spread Spectrum Digital Systems."

The noise-excited linear predictive (NELP) encoder 1265 may be used to code frames classified as unvoiced speech. NELP coding operates effectively, in terms of signal reproduction, where the speech signal 1206 has little or no pitch structure. More specifically, NELP may be used to encode speech that is noise-like in character, such as unvoiced speech or background noise. NELP uses a filtered pseudo-random noise signal to model unvoiced speech. The noise-like character of such speech segments can be reconstructed by generating random signals at the decoder and applying appropriate gains to them. NELP may use a simple model for the coded speech, thereby achieving a lower bit rate.

The transient encoder 1267 may be used to encode transient frames in the speech signal 1206 in accordance with the systems and methods disclosed herein. For example, the transient encoders 104, 604 described in connection with FIGS. 1 and 6 above may be used as the transient encoder 1267. Thus, for example, the electronic device 1202 may use the transient encoder 1267 to encode the speech signal 1206 when a transient frame is detected.

The quarter-rate prototype pitch period (QPPP) encoder 1269 may be used to code frames classified as voiced speech. Voiced speech contains slowly time varying periodic components that are exploited by the QPPP encoder 1269. The QPPP encoder 1269 codes a subset of the pitch periods within each frame. The remaining periods of the speech signal 1206 are reconstructed by interpolating between these prototype periods. By exploiting the periodicity of voiced speech, the QPPP encoder 1269 is able to reproduce the speech signal 1206 in a perceptually accurate manner.

The QPPP encoder 1269 may use prototype pitch period waveform interpolation (PPPWI), which may be used to encode speech data that is periodic in nature. Such speech is characterized by different pitch periods being similar to a "prototype" pitch period (PPP). This PPP may be voice information that the QPPP encoder 1269 uses to encode. A decoder can use this PPP to reconstruct other pitch periods in the speech segment.

The second switching block/module 1271 may be used to channel the (encoded) speech signal from the encoder 1263, 1265, 1267, 1269 that was used to code the current frame to the packet formatting block/module 1273. The packet formatting block/module 1273 may format the (encoded) speech signal 1206 into one or more packets (for transmission, for example). For instance, the packet formatting block/module 1273 may format a packet for a transient frame. In one configuration, the one or more packets produced by the packet formatting block/module 1273 may be transmitted to another device.

Figure 13:
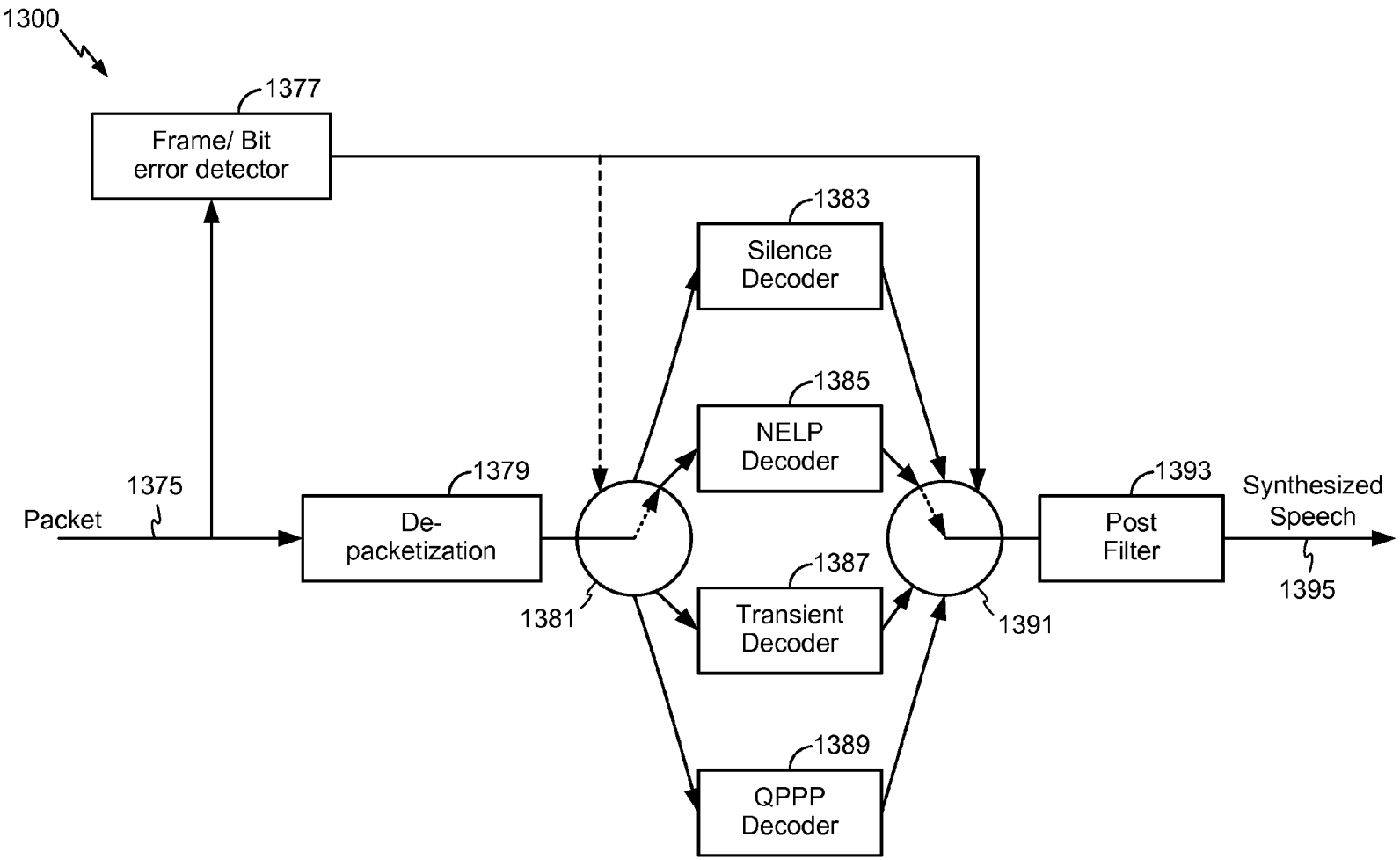
FIG. 13 is a block diagram illustrating one example of an electronic device in which systems and methods for decoding a transient frame may be implemented.

FIG. 13 is a block diagram illustrating one example of an electronic device 1300 in which systems and methods for decoding a transient frame may be implemented. In this example, the electronic device 1300 includes a frame/bit error detector 1377, a de-packetization block/module 1379, a first switching block/module 1381, a silence decoder 1383, a noise excited linear predictive (NELP) decoder 1385, a transient decoder 1387, a quarter-rate prototype pitch period (QPPP) decoder 1389, a second switching block/module 1391 and a post filter 1393.

The electronic device 1300 may receive a packet 1375. The packet 1375 may be provided to the frame/bit error detector 1377 and the de-packetization block/module 1379. The de-packetization block/module 1379 may "unpack" information from the packet 1375. For example, a packet 1375 may include header information, error correction information, routing information and/or other information in addition to payload data. The de-packetization block/module 1379 may extract the payload data from the packet 1375. The payload data may be provided to the first switching block/module 1381.

The frame/bit error detector 1377 may detect whether part or all of the packet 1375 was received incorrectly. For example, the frame/bit error detector 1377 may use an error detection code (sent with the packet 1375) to determine whether any of the packet 1375 was received incorrectly. In some configurations, the electronic device 1300 may control the first switching block/module 1381 and/or the second switching block/module 1391 based on whether some or all of the packet 1375 was received incorrectly, which may be indicated by the frame/bit error detector 1377 output.

Additionally or alternatively, the packet 1375 may include information that indicates which type of decoder should be used to decode the payload data. For example, an encoding electronic device 1202 may send two bits that indicate the encoding mode. The (decoding) electronic device 1300 may use this indication to control the first switching block/module 1381 and the second switching block/module 1391.

The electronic device 1300 may thus use the silence decoder 1383, the NELP decoder 1385, the transient decoder 1387 and/or the QPPP decoder 1389 to decode the payload data from the packet 1375. The decoded data may then be provided to the second switching block/module 1391, which may route the decoded data to the post filter 1393. The post filter 1393 may perform some filtering on the decoded data and output a synthesized speech signal 1395.

In one example, the packet 1375 may indicate (with the coding mode indicator) that a silence encoder 1263 was used to encode the payload data. The electronic device 1300 may control the first switching block/module 1381 to route the payload data to the silence decoder 1383. The decoded (silent) payload data may then be provided to the second switching block/module 1391, which may route the decoded payload data to the post filter 1393. In another example, the NELP decoder 1385 may be used to decode a speech signal (e.g., unvoiced speech signal) that was encoded by a NELP encoder 1265.

In another example, the packet 1375 may indicate that the payload data was encoded using a transient encoder 1267 (using a coding mode indicator, for example). Thus, the electronic device 1300 may use the first switching block/module 1381 to route the payload data to the transient decoder 1387. The transient decoder 1387 may decode the payload data as described above. In another example, the QPPP decoder 1389 may be used to decode a speech signal (e.g., voiced speech signal) that was encoded by a QPPP encoder 1269.

The decoded data may be provided to the second switching block/module 1391, which may route it to the post filter 1393. The post filter 1393 may perform some filtering on the signal, which may be output as a synthesized speech signal 1395. The synthesized speech signal 1395 may then be stored, output (using a speaker, for example) and/or transmitted to another device (e.g., a Bluetooth headset).

Figure 14:
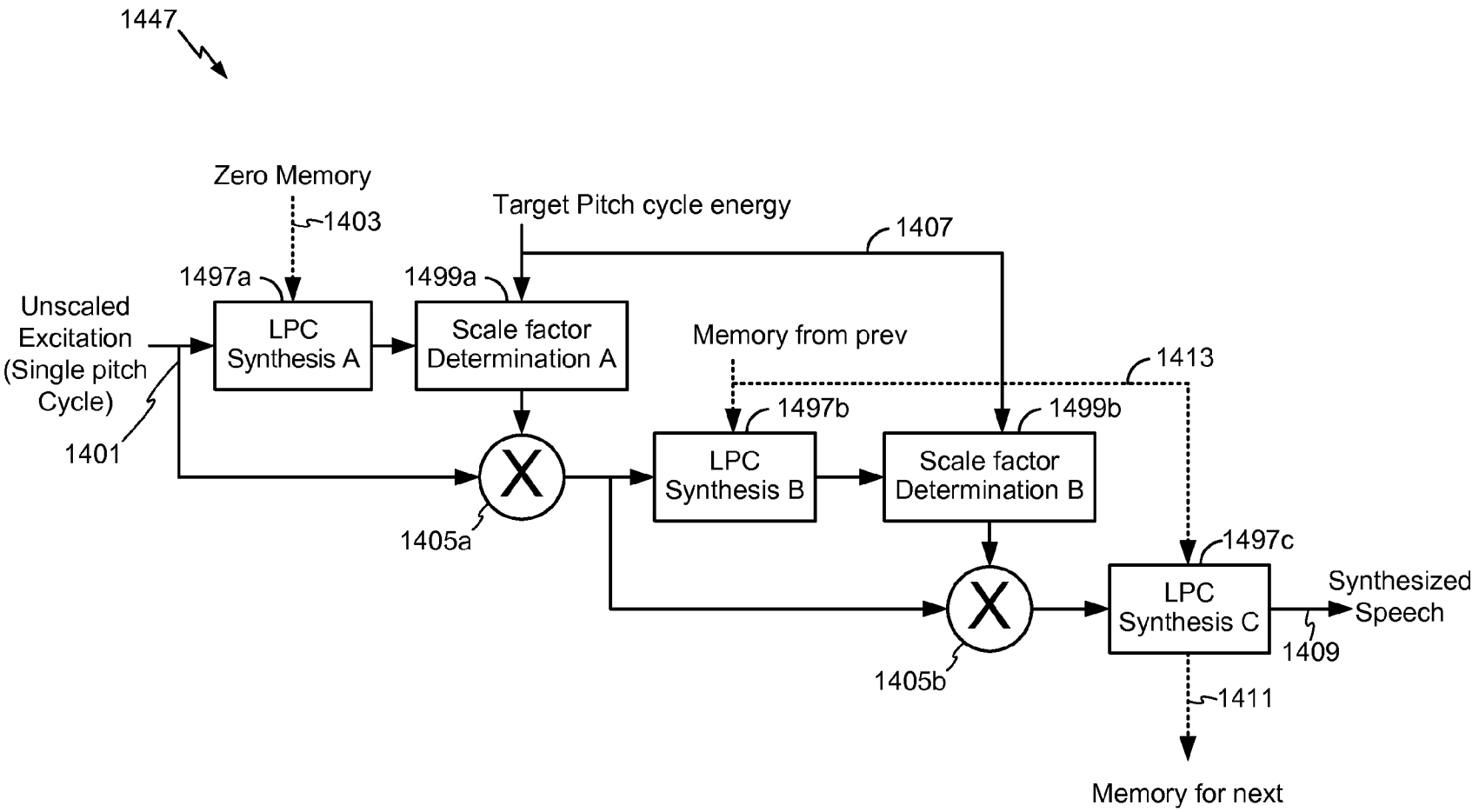
FIG. 14 is a block diagram illustrating one configuration of a pitch synchronous gain scaling and linear predictive coding (LPC) synthesis block/module.

FIG. 14 is a block diagram illustrating one configuration of a pitch synchronous gain scaling and LPC synthesis block/module 1447. The pitch synchronous gain scaling and LPC synthesis block/module 1447 illustrated in FIG. 14 may be one example of a pitch synchronous gain scaling and LPC synthesis block/module 947 shown in FIG. 9. As illustrated in FIG. 14, a pitch synchronous gain scaling and LPC synthesis block/module 1447 may include one or more LPC synthesis blocks/modules 1497*a-c*, one or more scale factor determination blocks/modules 1499*a-b* and/or one or more multipliers 1405*a-b*.

LPC synthesis block/module A 1497*a* may obtain or receive an unscaled excitation 1401 (for a single pitch cycle, for example). Initially, LPC synthesis block/module A 1497*a* may also use zero memory 1403. The output of LPC synthesis block/module A 1497*a* may be provided to scale factor determination block/module A 1499*a*. Scale factor determination block/module A 1499*a* may use the output from LPC synthesis A 1497*a* and a target pitch cycle energy input 1407 to produce a first scaling factor, which may be provided to a first multiplier 1405*a*. The multiplier 1405*a* multiplies the unscaled excitation signal 1401 by the first scaling factor. The (scaled) excitation signal or first multiplier 1405*a* output is provided to LPC synthesis block/module B 1497*b* and a second multiplier 1405*b*.

LPC synthesis block/module B 1497*b* uses the first multiplier 1405*a* output as well as a memory input 1413 (from previous operations) to produce a synthesized output that is provided to scale factor determination block/module B 1499*b*. For example, the memory input 1413 may come from the memory at the end of the previous frame. Scale factor determination block/module B 1499*b* uses the LPC synthesis block/module B 1497*b* output in addition to the target pitch cycle energy input 1407 in order to produce a second scaling factor, which is provided to the second multiplier 1405*b*. The second multiplier 1405*b* multiplies the first multiplier 1405*a* output (e.g., the scaled excitation signal) by the second scaling factor. The resulting product (e.g., the excitation signal that has been scaled a second time) is provided to LPC synthesis block/module C 1497*c*. LPC synthesis block/module C 1497*c* uses the second multiplier 1405*b* output in addition to the memory input 1413 to produce a synthesized speech signal 1409 and memory 1411 for further operations.

Figure 15:
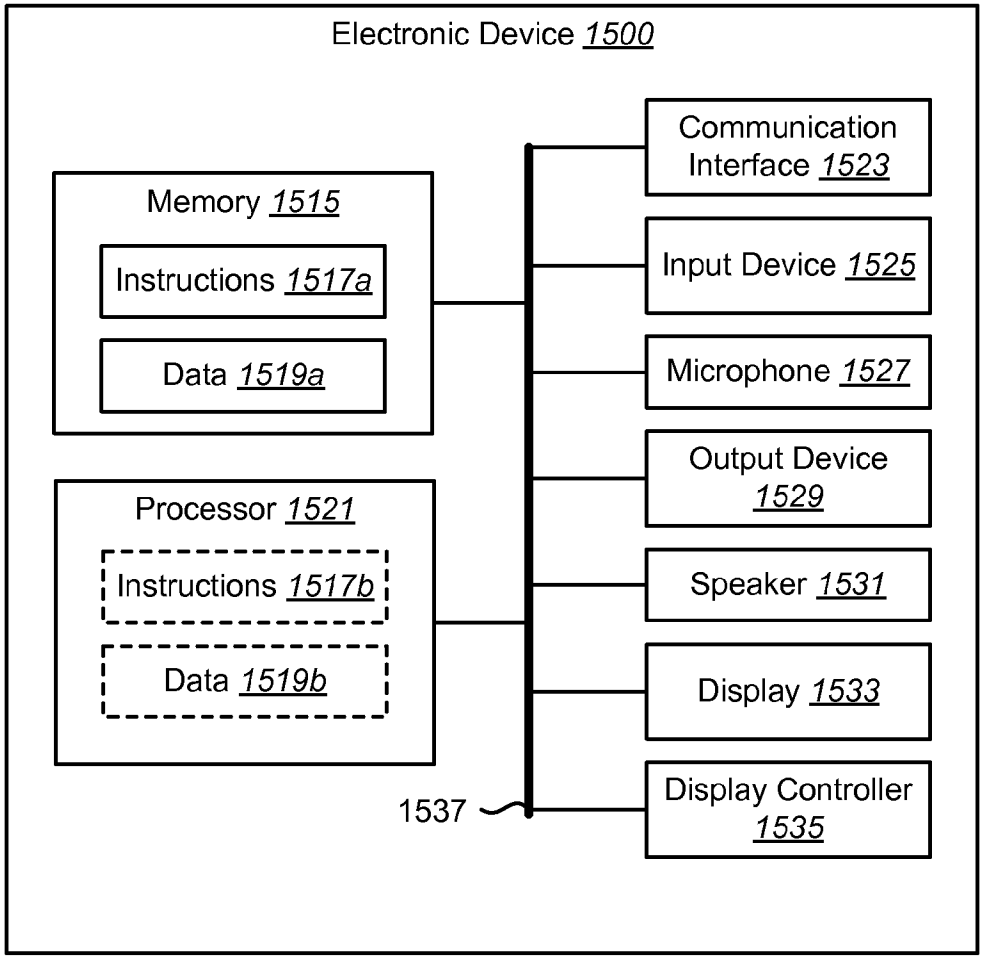
FIG. 15 illustrates various components that may be utilized in an electronic device.

FIG. 15 illustrates various components that may be utilized in an electronic device 1500. The illustrated components may be located within the same physical structure or in separate housings or structures. One or more of the electronic devices 102, 168, 1202, 1300 described previously may be configured similarly to the electronic device 1500. The electronic device 1500 includes a processor 1521. The processor 1521 may be a general purpose single- or multi-chip microprocessor (e.g., an ARM), a special purpose microprocessor (e.g., a digital signal processor (DSP)), a microcontroller, a programmable gate array, etc. The processor 1521 may be referred to as a central processing unit (CPU). Although just a single processor 1521 is shown in the electronic device 1500 of FIG. 15, in an alternative configuration, a combination of processors (e.g., an ARM and DSP) could be used.

The electronic device 1500 also includes memory 1515 in electronic communication with the processor 1521. That is, the processor 1521 can read information from and/or write information to the memory 1515. The memory 1515 may be any electronic component capable of storing electronic information. The memory 1515 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1519*a* and instructions 1517*a* may be stored in the memory 1515. The instructions 1517*a* may include one or more programs, routines, sub-routines, functions, procedures, etc. The instructions 1517*a* may include a single computer-readable statement or many computer-readable statements. The instructions 1517*a* may be executable by the processor 1521 to implement one or more of the methods 200, 300, 700, 800, 1000, 1100 described above. Executing the instructions 1517*a* may involve the use of the data 1519*a* that is stored in the memory 1515. FIG. 15 shows some instructions 1517*b* and data 1519*b* being loaded into the processor 1521 (which may come from instructions 1517*a* and data 1519*a*).

The electronic device 1500 may also include one or more communication interfaces 1523 for communicating with other electronic devices. The communication interfaces 1523 may be based on wired communication technology, wireless communication technology, or both. Examples of different types of communication interfaces 1523 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1500 may also include one or more input devices 1525 and one or more output devices 1529. Examples of different kinds of input devices 1525 include a keyboard, mouse, microphone, remote control device, button, joystick, trackball, touchpad, lightpen, etc. For instance, the electronic device 1500 may include one or more microphones 1527 for capturing acoustic signals. In one configuration, a microphone 1527 may be a transducer that converts acoustic signals (e.g., voice, speech) into electrical or electronic signals. Examples of different kinds of output devices 1529 include a speaker, printer, etc. For instance, the electronic device 1500 may include one or more speakers 1531. In one configuration, a speaker 1531 may be a transducer that converts electrical or electronic signals into acoustic signals. One specific type of output device which may be typically included in an electronic device 1500 is a display device 1533. Display devices 1533 used with configurations disclosed herein may utilize any suitable image projection technology, such as a cathode ray tube (CRT), liquid crystal display (LCD), light-emitting diode (LED), gas plasma, electroluminescence, or the like. A display controller 1535 may also be provided, for converting data stored in the memory 1515 into text, graphics, and/or moving images (as appropriate) shown on the display device 1533.

The various components of the electronic device 1500 may be coupled together by one or more buses, which may include a power bus, a control signal bus, a status signal bus, a data bus, etc. For simplicity, the various buses are illustrated in FIG. 15 as a bus system 1537. It should be noted that FIG. 15 illustrates only one possible configuration of an electronic device 1500. Various other architectures and components may be utilized.

Figure 16:
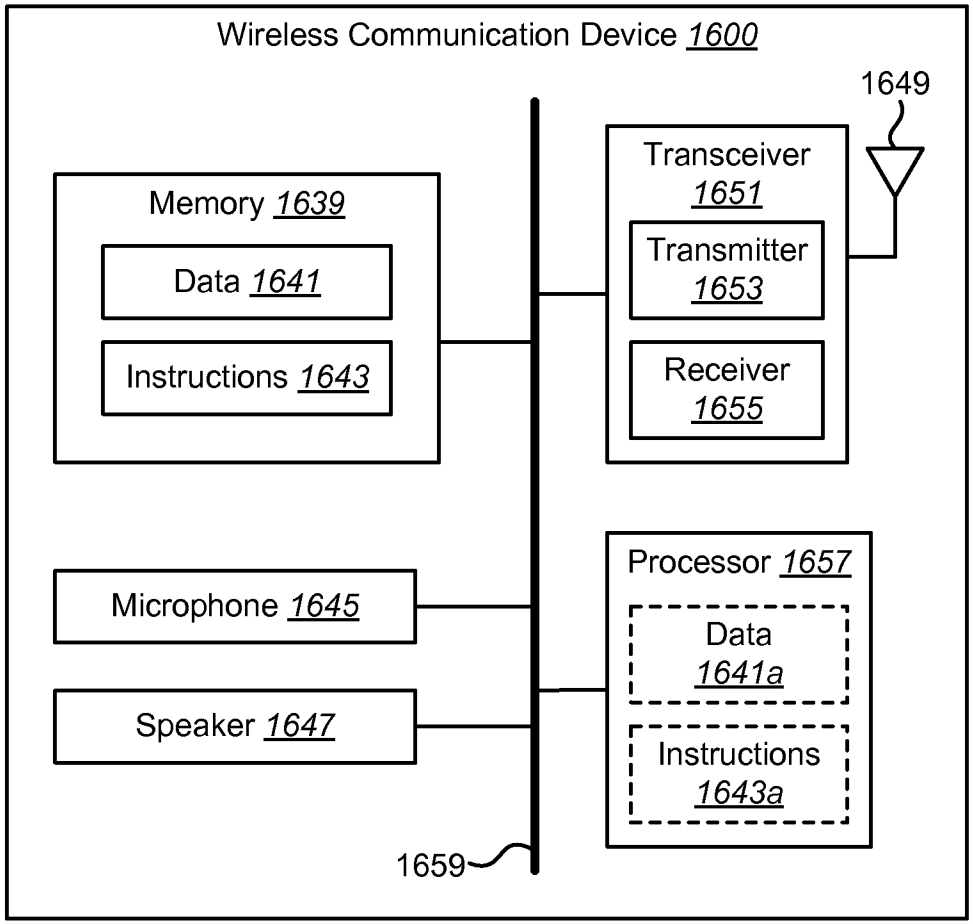
FIG. 16 illustrates certain components that may be included within a wireless communication device.

FIG. 16 illustrates certain components that may be included within a wireless communication device 1600. One or more of the electronic devices 102, 168, 1202, 1300, 1500 described above may be configured similarly to the wireless communication device 1600 that is shown in FIG. 16.

The wireless communication device 1600 includes a processor 1657. The processor 1657 may be a general purpose single- or multi-chip microprocessor (e.g., an ARM), a special purpose microprocessor (e.g., a digital signal processor (DSP)), a microcontroller, a programmable gate array, etc. The processor 1657 may be referred to as a central processing unit (CPU). Although just a single processor 1657 is shown in the wireless communication device 1600 of FIG. 16, in an alternative configuration, a combination of processors (e.g., an ARM and DSP) could be used.

The wireless communication device 1600 also includes memory 1639 in electronic communication with the processor 1657 (i.e., the processor 1657 can read information from and/or write information to the memory 1639). The memory 1639 may be any electronic component capable of storing electronic information. The memory 1639 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1641 and instructions 1643 may be stored in the memory 1639. The instructions 1643 may include one or more programs, routines, sub-routines, functions, procedures, code, etc. The instructions 1643 may include a single computer-readable statement or many computer-readable statements. The instructions 1643 may be executable by the processor 1657 to implement one or more of the methods 200, 300, 700, 800, 1000, 1100 described above. Executing the instructions 1643 may involve the use of the data 1641 that is stored in the memory 1639. FIG. 16 shows some instructions 1643*a* and data 1641*a* being loaded into the processor 1657 (which may come from instructions 1643 and data 1641).

The wireless communication device 1600 may also include a transmitter 1653 and a receiver 1655 to allow transmission and reception of signals between the wireless communication device 1600 and a remote location (e.g., another electronic device, communication device, etc.). The transmitter 1653 and receiver 1655 may be collectively referred to as a transceiver 1651. An antenna 1649 may be electrically coupled to the transceiver 1651. The wireless communication device 1600 may also include (not shown) multiple transmitters, multiple receivers, multiple transceivers and/or multiple antenna.

In some configurations, the wireless communication device 1600 may include one or more microphones 1645 for capturing acoustic signals. In one configuration, a microphone 1645 may be a transducer that converts acoustic signals (e.g., voice, speech) into electrical or electronic signals. Additionally or alternatively, the wireless communication device 1600 may include one or more speakers 1647. In one configuration, a speaker 1647 may be a transducer that converts electrical or electronic signals into acoustic signals.

The various components of the wireless communication device 1600 may be coupled together by one or more buses, which may include a power bus, a control signal bus, a status signal bus, a data bus, etc. For simplicity, the various buses are illustrated in FIG. 16 as a bus system 1659.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

The invention claimed is:

1. An electronic device for coding a transient frame, comprising:

a processor;

memory in electronic communication with the processor;

instructions stored in the memory, the instructions being executable to:

obtain a current transient frame;

obtain a residual signal based on the current transient frame;

determine a set of peak locations based on the residual signal;

determine whether to use a first transient coding mode or a second transient coding mode for coding the current transient frame based on at least the set of peak locations, comprising selecting the first transient coding mode for coding a transient frame detected as being continuous with respect to a previous frame or selecting the second transient coding mode for coding a transient frame detected as having no continuity with a previous frame; and synthesize an excitation for the current transient frame based on (A) waveform interpolation in response to determining to use the first transient coding mode or (B) repeated placement of a prototype waveform in response to determining to use the second transient coding mode.

2. The electronic device of claim 1, wherein the instructions are further executable to determine a plurality of scaling factors based on the excitation and the current transient frame.

3. The electronic device of claim 1, wherein determining a set of peak locations comprises:

calculating an envelope signal based on an absolute value of samples of the residual signal and a window signal;

calculating a first gradient signal based on a difference between the envelope signal and a time-shifted version of the envelope signal;

calculating a second gradient signal based on a difference between the first gradient signal and a time-shifted version of the first gradient signal;

selecting a first set of location indices where a second gradient signal value falls below a first threshold;

determining a second set of location indices from the first set of location indices by eliminating location indices where an envelope value falls below a second threshold relative to a largest value in the envelope; and determining a third set of location indices from the second set of location indices by eliminating location indices that do not meet a difference threshold with respect to neighboring location indices.

4. The electronic device of claim 1, wherein the instructions are further executable to:

perform a linear prediction analysis using the current transient frame and a signal prior to the current transient frame to obtain a set of linear prediction coefficients; and determine a set of quantized linear prediction coefficients based on the set of linear prediction coefficients.

5. The electronic device of claim 4, wherein obtaining the residual signal is further based on the set of quantized linear prediction coefficients.

6. The electronic device of claim 1, wherein the first transient coding mode is a "voiced transient" coding mode and the second transient coding mode is an "other transient" coding mode.

7. The electronic device of claim 1, wherein determining whether to use a first transient coding mode or a second transient coding mode is further based on a pitch lag, a previous frame type and an energy ratio.

8. The electronic device of claim 1, wherein determining whether to use the first transient coding mode or the second transient coding mode comprises:

determining an estimated number of peaks;

selecting (1) the first transient coding mode in response to determining that (1*a*) a number of peak locations is greater than or equal to the estimated number of peaks or (1*b*) a last peak in the set of peak locations is within a first distance from an end of the current transient frame and a first peak in the set of peak locations is within a second distance from a start of the current transient frame or (2) the second transient coding mode in response to determining that (2*a*) an energy ratio between a previous frame and the current transient frame is outside of a predetermined range or (2*b*) a frame type of the previous frame is unvoiced or silence.

9. The electronic device of claim 8, wherein the first distance is determined based on a pitch lag and the second distance is determined based on the pitch lag.

10. The electronic device of claim 1, wherein synthesizing an excitation based on the first transient coding mode comprises:

determining a location of a last peak in the current transient frame based on a last peak location in a previous frame and a pitch lag of the current transient frame; and synthesizing the excitation between a last sample of the previous frame and a first sample location of the last peak in the current transient frame using the waveform interpolation using a prototype waveform that is based on the pitch lag and a spectral shape.

11. The electronic device of claim 1, wherein synthesizing an excitation based on the second transient coding mode comprises synthesizing the excitation by repeatedly placing the prototype waveform starting at a first location, wherein the first location is determined based on a first peak location from the set of peak locations.

12. The electronic device of claim 11, wherein the prototype waveform is based on a pitch lag and a spectral shape, and wherein the prototype waveform is repeatedly placed a number of times that is based on the pitch lag, the first location and a frame size.

13. An electronic device for decoding a transient frame, comprising:

a processor;

memory in electronic communication with the processor;

instructions stored in the memory, the instructions being executable to:

obtain a frame type that indicates a current transient frame;

obtain a transient coding mode parameter;

determine whether to use a first transient coding mode or a second transient coding mode based on the transient coding mode parameter, the first transient coding mode being used for coding a transient frame detected during coding as being continuous with respect to a previous frame and the second transient coding mode being used for coding a transient frame detected during coding as having no continuity with the previous frame; and synthesize an excitation for the current transient frame based on (A) waveform interpolation in response to determining to use the first transient coding mode or (B) repeated placement of a prototype waveform in response to determining to use the second transient coding mode.

14. The electronic device of claim 13, wherein the instructions are further executable to:

obtain a pitch lag parameter; and determine a pitch lag based on the pitch lag parameter.

15. The electronic device of claim 13, wherein the instructions are further executable to:

obtain a plurality of scaling factors; and scale the excitation based on the plurality of scaling factors.

16. The electronic device of claim 13, wherein the instructions are further executable to:

obtain a quantized linear prediction coefficients parameter; and determine a set of quantized linear prediction coefficients based on the quantized linear prediction coefficients parameter.

17. The electronic device of claim 16, wherein the instructions are further executable to generate a synthesized speech signal based on the excitation and the set of quantized linear prediction coefficients.

18. The electronic device of claim 13, wherein synthesizing the excitation based on the first transient coding mode comprises:

determining a location of a last peak in a current transient frame based on a last peak location in a previous frame and a pitch lag of the current transient frame; and synthesizing the excitation between a last sample of the previous frame and a first sample location of the last peak in the current transient frame using the waveform interpolation using a prototype waveform that is based on the pitch lag and a spectral shape.

19. The electronic device of claim 13, wherein synthesizing an excitation based on the second transient coding mode comprises:

obtaining a first peak location; and synthesizing the excitation by repeatedly placing the prototype waveform starting at a first location, wherein the first location is determined based on the first peak location.

20. The electronic device of claim 19, wherein the prototype waveform is based on a pitch lag and a spectral shape, and wherein the prototype waveform is repeatedly placed a number of times that is based on the pitch lag, the first location and a frame size.

21. A method for coding a transient frame on an electronic device, comprising:

obtaining a current transient frame;

obtaining a residual signal based on the current transient frame;

determining a set of peak locations based on the residual signal;

determining whether to use a first transient coding mode or a second transient coding mode for coding the current transient frame based on at least the set of peak locations, comprising selecting the first transient coding mode for coding a transient frame detected as being continuous with respect to a previous frame or selecting the second transient coding mode for coding a transient frame detected as having no continuity with a previous frame; and synthesizing an excitation for the current transient frame based on (A) waveform interpolation in response to determining to use the first transient coding mode or (B) repeated placement of a prototype waveform in response to determining to use the second transient coding mode.

22. The method of claim 21, further comprising determining a plurality of scaling factors based on the excitation and the current transient frame.

23. The method of claim 21, wherein determining a set of peak locations comprises:

calculating an envelope signal based on an absolute value of samples of the residual signal and a window signal;

calculating a first gradient signal based on a difference between the envelope signal and a time-shifted version of the envelope signal;

calculating a second gradient signal based on a difference between the first gradient signal and a time-shifted version of the first gradient signal;

selecting a first set of location indices where a second gradient signal value falls below a first threshold;

determining a second set of location indices from the first set of location indices by eliminating location indices where an envelope value falls below a second threshold relative to a largest value in the envelope; and determining a third set of location indices from the second set of location indices by eliminating location indices that do not meet a difference threshold with respect to neighboring location indices.

24. The method of claim 21, further comprising:

performing a linear prediction analysis using the current transient frame and a signal prior to the current transient frame to obtain a set of linear prediction coefficients; and determining a set of quantized linear prediction coefficients based on the set of linear prediction coefficients.

25. The method of claim 24, wherein obtaining the residual signal is further based on the set of quantized linear prediction coefficients.

26. The method of claim 21, wherein the first transient coding mode is a "voiced transient" coding mode and the second transient coding mode is an "other transient" coding mode.

27. The method of claim 21, wherein determining whether to use a first transient coding mode or a second transient coding mode is further based on a pitch lag, a previous frame type and an energy ratio.

28. The method of claim 21, wherein determining whether to use the first transient coding mode or the second transient coding mode comprises:

determining an estimated number of peaks;

selecting (1) the first transient coding mode in response to determining that (1*a*) a number of peak locations is greater than or equal to the estimated number of peaks or (1*b*) a last peak in the set of peak locations is within a first distance from an end of the current transient frame and a first peak in the set of peak locations is within a second distance from a start of the current transient frame or (2) the second transient coding mode in response to determining that (2*a*) an energy ratio between a previous frame and the current transient frame is outside of a predetermined range or (2*b*) a frame type of the previous frame is unvoiced or silence.

29. The method of claim 28, wherein the first distance is determined based on a pitch lag and the second distance is determined based on the pitch lag.

30. The method of claim 21, wherein synthesizing an excitation based on the first transient coding mode comprises:

determining a location of a last peak in the current transient frame based on a last peak location in a previous frame and a pitch lag of the current transient frame; and synthesizing the excitation between a last sample of the previous frame and a first sample location of the last peak in the current transient frame using the waveform interpolation using a prototype waveform that is based on the pitch lag and a spectral shape.

31. The method of claim 21, wherein synthesizing an excitation based on the second transient coding mode comprises synthesizing the excitation by repeatedly placing the prototype waveform starting at a first location, wherein the first location is determined based on a first peak location from the set of peak locations.

32. The method of claim 31, wherein the prototype waveform is based on a pitch lag and a spectral shape, and wherein the prototype waveform is repeatedly placed a number of times that is based on the pitch lag, the first location and a frame size.

33. A method for decoding a transient frame on an electronic device, comprising:

obtaining a frame type that indicates a current transient frame;

obtaining a transient coding mode parameter;

determining whether to use a first transient coding mode or a second transient coding mode based on the transient coding mode parameter, the first transient coding mode being used for coding a transient frame detected during coding as being continuous with respect to a previous frame and the second transient coding mode being used for coding a transient frame detected during coding as having no continuity with the previous frame; and synthesizing an excitation for the current transient frame based on (A) waveform interpolation in response to determining to use the first transient coding mode or (B) repeated placement of a prototype waveform in response to determining to use the second transient coding mode.

34. The method of claim 33, further comprising:

obtaining a pitch lag parameter; and determining a pitch lag based on the pitch lag parameter.

35. The method of claim 33, further comprising:

obtaining a plurality of scaling factors; and scaling the excitation based on the plurality of scaling factors.

36. The method of claim 33, further comprising:

obtaining a quantized linear prediction coefficients parameter; and determining a set of quantized linear prediction coefficients based on the quantized linear prediction coefficients parameter.

37. The method of claim 36, further comprising generating a synthesized speech signal based on the excitation and the set of quantized linear prediction coefficients.

38. The method of claim 33, wherein synthesizing the excitation based on the first transient coding mode comprises:

determining a location of a last peak in a current transient frame based on a last peak location in a previous frame and a pitch lag of the current transient frame; and synthesizing the excitation between a last sample of the previous frame and a first sample location of the last peak in the current transient frame using the waveform interpolation using a prototype waveform that is based on the pitch lag and a spectral shape.

39. The method of claim 33, wherein synthesizing an excitation based on the second transient coding mode comprises:

obtaining a first peak location; and synthesizing the excitation by repeatedly placing the prototype waveform starting at a first location, wherein the first location is determined based on the first peak location.

40. The method of claim 39, wherein the prototype waveform is based on a pitch lag and a spectral shape, and wherein the prototype waveform is repeatedly placed a number of times that is based on the pitch lag, the first location and a frame size.

41. A computer-program product for coding a transient frame, comprising a non-transitory tangible computer-readable medium having instructions thereon, the instructions comprising:

code for causing an electronic device to obtain a current transient frame;

code for causing the electronic device to obtain a residual signal based on the current transient frame;

code for causing the electronic device to determine a set of peak locations based on the residual signal;

code for causing the electronic device to determine whether to use a first transient coding mode or a second transient coding mode for coding the current transient frame based on at least the set of peak locations, comprising selecting the first transient coding mode for coding a transient frame detected as being continuous with respect to a previous frame or selecting the second transient coding mode for coding a transient frame detected as having no continuity with a previous frame; and code for causing the electronic device to synthesize an excitation for the current transient frame based on (A) waveform interpolation in response to determining to use the first transient coding mode or (B) repeated placement of a prototype waveform in response to determining to use the second transient coding mode.

42. The computer-program product of claim 41, wherein determining whether to use the first transient coding mode or the second transient coding mode comprises:

determining an estimated number of peaks;

selecting (1) the first transient coding mode in response to determining that (1*a*) a number of peak locations is greater than or equal to the estimated number of peaks or (1*b*) a last peak in the set of peak locations is within a first distance from an end of the current transient frame and a first peak in the set of peak locations is within a second distance from a start of the current transient frame or (2) the second transient coding mode in response to determining that (2*a*) an energy ratio between a previous frame and the current transient frame is outside of a predetermined range or (2*b*) a frame type of the previous frame is unvoiced or silence.

43. The computer-program product of claim 41, wherein synthesizing an excitation based on the second transient coding mode comprises synthesizing the excitation by repeatedly placing the prototype waveform starting at a first location, wherein the first location is determined based on a first peak location from the set of peak locations.

44. A computer-program product for decoding a transient frame, comprising a non-transitory tangible computer-readable medium having instructions thereon, the instructions comprising:

code for causing an electronic device to obtain a frame type that indicates a current transient frame;

code for causing the electronic device to obtain a transient coding mode parameter;

code for causing the electronic device to determine whether to use a first transient coding mode or a second transient coding mode based on the transient coding mode parameter, the first transient coding mode being used for coding a transient frame detected during coding as being continuous with respect to a previous frame and the second transient coding mode being used for coding a transient frame detected during coding as having no continuity with the previous frame; and code for causing the electronic device to synthesize an excitation for the current transient frame based on (A) waveform interpolation in response to determining to use the first transient coding mode or (B) repeated placement of a prototype waveform in response to determining to use the second transient coding mode.

45. The computer-program product of claim 44, wherein synthesizing an excitation based on the second transient coding mode comprises:

obtaining a first peak location; and synthesizing the excitation by repeatedly placing the prototype waveform starting at a first location, wherein the first location is determined based on the first peak location.

46. An apparatus for coding a transient frame, comprising:

means for obtaining a current transient frame;

means for obtaining a residual signal based on the current transient frame;

means for determining a set of peak locations based on the residual signal;

means for determining whether to use a first transient coding mode or a second transient coding mode for coding the current transient frame based on at least the set of peak locations, comprising selecting the first transient coding mode for coding a transient frame detected as being continuous with respect to a previous frame or selecting the second transient coding mode for coding a transient frame detected as having no continuity with a previous frame; and means for synthesizing an excitation for the current transient frame based on (A) waveform interpolation in response to determining to use the first transient coding mode or (B) repeated placement of a prototype waveform in response to determining to use the second transient coding mode.

47. The apparatus of claim 46, wherein the means for determining whether to use the first transient coding mode or the second transient coding mode comprises:

means for determining an estimated number of peaks;

means for selecting (1) the first transient coding mode in response to determining that (1*a*) a number of peak locations is greater than or equal to the estimated number of peaks or (1*b*) a last peak in the set of peak locations is within a first distance from an end of the current transient frame and a first peak in the set of peak locations is within a second distance from a start of the current transient frame or (2) the second transient coding mode in response to determining that (2*a*) an energy ratio between a previous frame and the current transient frame is outside of a predetermined range or (2*b*) a frame type of the previous frame is unvoiced or silence.

48. The apparatus of claim 46, wherein the means for synthesizing an excitation based on the second transient coding mode comprises means for synthesizing the excitation by repeatedly placing the prototype waveform starting at a first location, wherein the first location is determined based on a first peak location from the set of peak locations.

49. An apparatus for decoding a transient frame, comprising:

means for obtaining a frame type that indicates a current transient frame;

means for obtaining a transient coding mode parameter;

means for determining whether to use a first transient coding mode or a second transient coding mode based on the transient coding mode parameter, the first transient coding mode being used for coding a transient frame detected during coding as being continuous with respect to a previous frame and the second transient coding mode being used for coding a transient frame detected during coding as having no continuity with the previous frame; and means for synthesizing an excitation for the current transient frame based on (A) waveform interpolation in response to determining to use the first transient coding mode or (B) repeated placement of a prototype waveform in response to determining to use the second transient coding mode.

50. The apparatus of claim 49, wherein means for synthesizing an excitation based on the second transient coding mode comprises:

means for obtaining a first peak location; and means for synthesizing the excitation by repeatedly placing the prototype waveform starting at a first location, wherein the first location is determined based on the first peak location.

51. The electronic device of claim 1, wherein the instructions are further executable to discard a remainder of the prototype waveform in a case that the second transient coding mode is determined for the current transient frame, that a smallest integer number of prototype waveforms required to fill the current transient frame does not fit within the current transient frame, and that a next frame is a non-transient frame that is coded using a coding that is different from the first transient coding mode and the second transient coding mode.

* * * * *